US005422232A

United States Patent [19]

Asami et al.

[11] Patent Number: 5,422,232

[45] Date of Patent: Jun. 6, 1995

[54] SILVER HALIDE COLOR PHOTOGRAPHIC LIGHT-SENSITIVE MATERIAL AND METHOD FOR FORMING COLOR IMAGES BY USING THE SAME

[75] Inventors: Masahiro Asami; Naoto Ooshima, both of Minami-ashigara, Japan

[73] Assignee: Fuji Photo Film Co., Ltd., Japan

[21] Appl. No.: 158,988

[22] Filed: Nov. 30, 1993

[30] Foreign Application Priority Data

Nov. 30, 1992 [JP] Japan ..... 4-340978
Nov. 30, 1992 [JP] Japan ..... 4-340979

[51] Int. Cl.[6] ..... G03C 1/76

[52] U.S. Cl. ..... 430/533; 430/505; 430/603; 430/605; 430/963; 430/950; 430/538; 430/545; 430/551

[58] Field of Search ..... 430/505, 533, 603, 605, 430/963, 950, 538, 545, 551

[56] References Cited

U.S. PATENT DOCUMENTS

| | | | |
|---|---|---|---|
| 4,910,235 | 3/1990 | Satake et al. | 523/171 |
| 5,061,612 | 10/1991 | Kiyohara et al. | 430/533 |
| 5,093,227 | 3/1992 | Nakazyo et al. | 430/551 |
| 5,198,328 | 3/1993 | Shiba et al. | 430/538 |
| 5,268,261 | 12/1993 | Sakakibara et al. | 430/505 |
| 5,272,053 | 12/1993 | Okumura et al. | 430/545 |

FOREIGN PATENT DOCUMENTS

| | | |
|---|---|---|
| 0459458 | 4/1991 | European Pat. Off. . |
| 0507489 | 7/1992 | European Pat. Off. . |
| 0512496 | 11/1992 | European Pat. Off. . |

OTHER PUBLICATIONS

Research Disclosure, vol. 343, No. 90, 26 Nov. 1992, Havant GB, pp. 869–874, "Photographic Light-Sensitive Silver Halide Film Can Comprise A Transparent Magnetic Recording . . . Support".

*Primary Examiner*—Thomas R. Neville
*Attorney, Agent, or Firm*—Sughrue, Mion, Zinn, Macpeak & Seas

[57] ABSTRACT

Disclosed herein is a silver halide color photographic light-sensitive material comprising at least three silver halide emulsion layers having different color sensitivities and formed on a reflective support. The support comprises a substrate and a composition layer laminated on at least the surface of the substrate on which the emulsion layers are coated, and made of a thermoplastic resin containing polyester as a main component and a white pigment mixed and dispersed in the resin. The polyester is a polyester synthesized by the polycondensation of a dicarboxylic acid and a diol. The silver halide contained in the material is silver chlorobromide having silver chloride content of 95 mol % or more, or silver chloride. The ratio of the coated amount of all hydrophilic colloid used in the material to the coated amount of silver contained in all silver halide used in the material ranges from 5.0 to 30. Also disclosed herein is a silver halide color photographic light-sensitive material comprising at least one light-sensitive emulsion layer formed on a reflective support. The support comprises a raw paper having pH of 5 to 9 and a composition coated on the surface of the paper on which the emulsion layers are formed, and made of a thermoplastic resin containing polyester as a main component and a white pigment mixed and dispersed in the resin. The light-sensitive emulsion layer contains a silver halide emulsion which is selenium-sensitized, tellurium-sensitized or gold-sensitized, and which contains 95 mol % or more of silver chloride, and a method for forming a color image by subjecting the material to exposure and color processing.

16 Claims, No Drawings

SILVER HALIDE COLOR PHOTOGRAPHIC LIGHT-SENSITIVE MATERIAL AND METHOD FOR FORMING COLOR IMAGES BY USING THE SAME

BACKGROUND OF THE INVENTION

1. Field of the Invention

The present invention relates to a silver halide color photographic light-sensitive material and a method for forming color images by using this material, and more particularly to a silver halide color photographic light sensitive material which can provide color prints excelling in sharpness, having but only a little coloring at the cut edges, and involving but small chromatic aberration of scanning periphery at scanning exposure system, and also to a silver halide color photographic light-sensitive material which excels in surface smoothness and surface gloss, which has resistance to degradation on performance under extended storage period, and which can form high-quality images, and also to a method for forming color images by using this material.

2. Description of the Related Art

Color photographs are very popular today. Thanks to the advances in the manufacture of light-sensitive materials and also in the techniques of processing, color photographs can be available quickly and almost anywhere. In particular, color photographic printing paper used in making color prints for exhibition can now be processed at high speed due to the water-resistant characteristic of the paper support which are coated with resin on both sides, the light-sensitive material using high-silver chloride emulsion, and the method of processing the material. Both the material and the method are disclosed in PCT International Publication WO 87-04534.

Technical development has been made to increase the processing speed, as well as to enhance the image quality of print images. The image quality of color prints commercially produced at present is fairly good because of improvements which have been made thus far. There is the demand, however, to further heighten the image quality of color prints.

Image quality of color images depend on various properties such as gradient reproduction, color reproduction, graininess, sharpness, and the like. Of these, sharpness is an important property since it determines the degree in details and stereoscopic expression of the resultant image. Therefore, there has been the demand for techniques to enhance the sharpness of color images.

However, the enhancement in sharpness achieved in the recent development of techniques of color-print materials cannot be considered sufficient, largely because of the properties of the paper support which are coated with polyolefin resin for the purpose of processing the material easily and quickly. The color image formed on photographic paper whose support consists of a paper coated with a water-resistant resin is inferior, in terms of sharpness, to the color image formed on the conventional photographic paper whose support consists of a paper coated with baryta. This is because the water-resistant resin layer covering that surface of the support on which light-sensitive emulsions are coated only has a small amount of white pigment kneaded in the resin. The insufficiency of white pigment is believed to cause the light applied to the material during the exposure process to scatter and disperse, resulting in deterioration of image.

Some attempts, not to say many, have been made to compensate for the deficiency of the supports which consist of the paper coated with a water-resistant resin.

Techniques of increasing the amount of white pigment dispersed in polyolefin resin are disclosed in, for example, JP-A-51-6531, JP-A-52-35625, JP-B-55-108658, JP-A-55-113039 and JP-A-57-151942. ("JP-A" means Published Unexamined Japanese Patent Application, and "JP-B" means Published Examined Japanese Patent Application.) Although these techniques improve sharpness, the pigment dispersion in the resin becomes less obvious as the white pigment content increases. Probably due to this insufficient pigment dispersion, the resin coating layer is likely to have defects such as micropores during its forming, ultimately deteriorating the surface gloss or surface smoothness of the the water-resistant resin layer covering that surface of the paper. Consequently, the technique does not serve to sufficiently increase the white pigment content.

Techniques of more increasing the white pigment content are disclosed in JP-A-57-27257 and JP-A-57-49946. In these techniques, a mixture of a white pigment and a composition which can be curable when irradiated with an electron beam is coated on a support, and an electron beam is irradiated to the coating, thereby to form a water-resistant resin layer. With these techniques, however, it is difficult to produce supports for light-sensitive materials in large quantities, making it hard to provide inexpensive supports.

Other methods of increasing the white pigment content are disclosed in JP-B-57-53937, JP-A-50-44818, JP-A-57-64235, and JP-A-59-177542. In these methods, a hydrophilic colloid layer containing a white pigment is interposed between a polyolefin-coated paper support and a light-sensitive silver halide emulsion layer. When the methods are employed, the white pigment content in the hydrophilic colloid layer can be increased to enhance the sharpness of color images. These method, however, have certain disadvantage as the coating amount of a white pigment is increased. First, it is difficult to produce supports for light-sensitive materials in large quantities. Second, the supports obtained exhibit only a small flexural strength.

European Patent EP-0,507,489 describes that smooth resin-coated water-resistant paper supports excelling in surface gloss can be obtained by covering raw paper with a water-resistant resin which comprises 70% by weight or more of polyester and titanium dioxide dispersed in the polyester. However, when a reflective support is made as described and then coated with high-silver chloride emulsions suitable for high-speed processing, the print samples processed, which are yet to be not colored, will be colored at the cut edges. Once such coloring has occurred, the whiteness of the prints will be greatly impaired at the edges if the prints are piled one upon another. As a consequence, their quality, and thus their commercial value, will be reduced.

Therefore, it has been demanded that techniques be developed to enhance the sharpness of color images, wherein using a water-resistant resin-coated paper supports which are suitable for easy and speedy processing can be used without impairing other properties of the color images.

A color photograph is a dye image obtained by the reaction of dye-forming couplers with the oxidized form of development agent produced by which a light-sensitive material comprising a support having provided thereon dye-forming couplers and silver halide emulsions is developed with a color developing agent of aromatic primary amine series.

In the color photograph business, there is a strong demand for systems to perform easy and speedy color processing. A number of improvements have been made, and new systems capable of performing faster color processing have been developed, each every few years.

To increase the processing speed, it is necessary to shorten the periods of the process steps, i.e., color development, bleach-fixing, washing, and drying. A method of increasing the processing speed is disclosed in PCT International Publication WO 87-04534. In this method, a color photographic light-sensitive material using high-silver chloride emulsions as photographic emulsions is processed at high speed. The publication teaches that the use of high-silver chloride emulsions is desirable for the purpose of increasing the processing speed.

Thanks to these efforts, methods of forming an image of high-quality images easily are now widely employed, all of which involve color negative images are printed on silver halide color photographic printing paper coated with high-silver chloride emulsions.

In recent years, it has become possible to provide prints in various sizes, such as panorama size, high-vision size, and the like, to meet the variety of users' needs. Not only is there a demand for various sizes, there is also a demand for various textures such as smoothness and gloss in the printing material. Supports which may satisfy the latter demand are being developed at present.

European Patent EP-0,507,489 describes that polyester may be used as a water-resistant resin to prepare print supports which are superior, in terms of surface gloss and surface smoothness, to the conventional ones prepared by using polyolefin.

The inventors hereof have conducted research in order to provide a silver halide color photographic light-sensitive material, especially color printing paper which excels in gloss and surface smoothness. As a result, they found that the print supports prepared by using polyester as a water-resistant resin had surface gloss and surface smoothness improved over those of the conventional print supports prepared by using polyolefin, but the resultant light-sensitive material became more likely to be desensitized when applied with a pressure, as it was when stored over a long period of time.

SUMMARY OF THE INVENTION

Accordingly it is the object of the present invention is to provide a color photographic light-sensitive material, particularly color printing paper, which can form images excelling in sharpness of obtained images and which can be processed at high speed. More particularly, the object of the present invention is to provide a silver halide color photographic light-sensitive material which excels in surface gloss and surface smoothness, which does not lose pressure resistance even after stored for a long time, and which can provide color prints excelling in sharpness and surface gloss and having no coloring at the cut edges after processing even if coated with the high-silver chloride emulsions desirable for achieving high-speed processing, and also to provide a method of forming color images by using this material.

The above-mentioned object of the present invention has been attained by the following means described in (1) to (18):

(1) A silver halide color photographic light-sensitive material comprising a reflective support having provided thereon at least one silver halide emulsion layer containing a yellow dye-forming coupler, at least one silver halide emulsion layer containing a magenta dye-forming coupler, and at least one silver halide emulsion layer containing a cyan dye-forming coupler, the support comprising a substrate and a composition layer laminated on at least the surface of the substrate on which the emulsion layers are coated, and made of a thermoplastic resin containing polyester as a main component and a white pigment mixed and dispersed in the resin, the polyester having been synthesized by the polycondensation of a dicarboxylic acid and a diol; the silver halide contained in the light-sensitive material being silver chlorobromide having silver chloride content of 95 mol % or more, or silver chloride; and the ratio of the coated amount ($g/m^2$) of all hydrophilic colloid coated on a support to the coated amount ($g/m^2$) of silver contained in all silver halide used in the light-sensitive material ranging from 5.0 to 30.

(2) A silver halide color photographic light-sensitive material comprising a reflective support having provided thereon at least one silver halide emulsion layer containing a yellow dye-forming coupler, at least one silver halide emulsion layer containing a magenta dye-forming coupler, and at least one silver halide emulsion layer containing a cyan dye-forming coupler, the support comprising a substrate and a composition layer laminated on at least the surface of the substrate on which the emulsion layers are coated, and made of a thermoplastic resin containing polyester as a main component and a white pigment mixed and dispersed in the resin, the polyester having been synthesized by the polycondensation of a dicarboxylic acid and a diol; the silver halide contained in the light-sensitive material being silver chlorobromide having silver chloride content of 95 mol % or more, or silver chloride and being gold sensitized; and the ratio of the coated amount ($g/m^2$) of all hydrophilic colloid coated on a support to the coated amount ($g/m^2$) of silver contained in all silver halide used in the light-sensitive material ranging from 5.0 to 30.

(3) The silver halide color photographic light-sensitive material described in item (2), wherein the polyester is polyethylene terephthalate as a main component.

(4) The silver halide color photographic light-sensitive material described in item (2), wherein the polyester is a polyester synthesized by the polycondensation of a dicarboxylic acid which is a mixture of terephthalic acid and isophthalic acid (molar ratio of 9:1 to 2;8) and a diol.

(5) The silver halide color photographic light-sensitive material described in item (2), wherein the polyester is a polyester synthesized by the polycondensation of a dicarboxy acid which is a mixture of terephthalic acid and naphthalenedicarboxylic acid (molar ratio of 9:1 to 2:8) and a diol.

(6) The silver halide color photographic light-sensitive material described in item (2), wherein the diol component is ethylene glycol.

(7) The silver halide color photographic light-sensitive material described in item (2), wherein the ratio by weight of the white pigment to the resin ranges from 5:95 to 70:30.

(8) A method for forming a color image, comprising subjecting a silver halide photographic light-sensitive material described in item (2) to exposure by a scanning exposure system with an exposing time per picture element which is shorter than $10^{-4}$ second, followed by color processing.

(9) A silver halide color photographic light-sensitive material comprising a reflective support having provided thereon at least one light-sensitive emulsion layer, the reflective support comprising a raw paper having pH of 5 to 9 and a composition laminated on the surface of the raw paper on which the emulsion layers are coated, and made of a resin containing polyester as a main component and a white pigment mixed and dispersed in the resin; and the light-sensitive emulsion layer containing a silver halide emulsion which is selenium-sensitized, tellurium-sensitized or gold-sensitized, and which contains 95 mol % or more of silver chloride.

(10) A silver halide color photographic light-sensitive material comprising a reflective support having provided thereon at least one light-sensitive emulsion layer, the reflective support comprising a raw paper having pH of 5 to 9 and a composition laminated on the surface of the raw paper on which the emulsion layers are coated, and made of a resin containing polyester as a main component and a white pigment mixed and dispersed in the resin; and the light-sensitive emulsion layer containing a silver halide emulsion which is selenium-sensitized, tellurium-sensitized or gold-sensitized, and which contains 95 mol % or more of silver chloride, and wherein the light-sensitive emulsion layer contains at least one of the compounds represented by the following Formulas (I), (II) and (III):

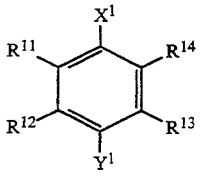

Formula (I)

wherein $X^1$ and $Y^1$ independently represent a hydroxyl group, $—NR^{15}R^{16}$, or $—NHSO_2R^{17}$; $R^{11}$, $R^{12}$, $R^{13}$ and $R^{14}$ independently represent a hydrogen atom or any given substituent group; $R^{11}$ and $R^{12}$, and $R^{13}$ and $R^{14}$ may be bonded to each other to form a carbon ring, respectively; $R^{15}$ and $R^{16}$ independently represent a hydrogen atom, an alkyl group, an aryl group, or a heterocyclic group; $R^{15}$ and $R^{16}$ may be bonded to each other to form a nitrogen-containing heterocyclic ring; and $R^{17}$ represents an alkyl group, an aryl group, an amino group, or a heterocyclic group.

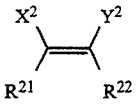

Formula (II)

wherein $X^2$ and $Y^2$ independently represent a hydroxyl group, $—NR^{23}R^{24}$, or $—NHSO_2R^{25}$; $R^{21}$ and $R^{22}$ independently represent a hydrogen atom or any given substituent group; $R^{21}$ and $R^{22}$ may be bonded to each other to form a carbon ring or a heterocyclic ring; $R^{23}$ and $R^{24}$ independently represent a hydrogen atom, an alkyl group, an aryl group, or a heterocyclic group; $R^{23}$ and $R^{24}$ may be bonded to each other to form a nitrogen-containing heterocyclic ring; and $R^{25}$ represents an alkyl group, an aryl group, an amino group, or a heterocyclic group.

$$R^{31}\text{-}(Y^3)_n\text{-}NH\text{-}X^3$$

Formula (III)

wherein $X^3$ represents a hydroxyl group or $—NR^{32}R^{33}$; $Y^3$ represents a —CO— or $—SO_2—$; $R^{31}$ represents a hydrogen atom or any given substituent group; n is 0 or 1; $R^{32}$ and $R^{33}$ independently represent a hydrogen atom, an alkyl group, an aryl group, or a heterocyclic group; $R^{31}$ and $R^{32}$, and $R^{32}$ and $R^{33}$ may be bonded to each other to form a nitrogen-containing heterocyclic ring, respectively.

(11) The silver halide color photographic light-sensitive material described in item (10), wherein the polyester is polyethylene terephthalate as a main component.

(12) The silver halide color photographic light-sensitive material described in item (10), wherein the polyester is a polyester synthesized by the polycondensation of a dicarboxylic acid and a diol; and the dicarboxylic acid is a mixture of terephthalic acid and isophthalic acid.

(13) The silver halide color photographic light-sensitive material described in item (10), wherein the polyester is a polyester synthesized by the polycondensation of a dicarboxylic acid and a diol; and the dicarboxylic acid is a mixture of terephthalic acid and naphthalenedicarboxylic acid.

(14). The silver halide color photographic light-sensitive material described in item (10), wherein the diol is ethylene glycol.

(15) The silver halide color photographic light-sensitive material described in item (10), wherein the white pigment is titanium dioxide, and the ratio by weight of the white pigment to the resin is polyester ranges from 5:95 to 50:50.

(16) The silver halide color photographic light-sensitive material described in item (10), wherein the light-sensitive emulsion layer contains at least one mercapto heterocyclic compound.

(17) A method for forming a color image, comprising subjecting a silver halide photographic light-sensitive material described in item (10) to exposure to light applied through a color negative film having a transparent magnetic recording layer, and then to color processing.

(18) A method for forming a color image, comprising subjecting a silver halide photographic light-sensitive material described in item (10) to exposure by a scanning exposure system with an exposing time per picture element which is shorter than $10^{-4}$ second, followed by color processing.

DETAILED DESCRIPTION OF THE PREFERRED EMBODIMENTS

The present invention will be described in detail as follows.

The term "main component" used in the present specification refers to the one which comprises 50% by weight or more of the total content.

The reflective support for use in the present invention is preferably one comprising a substrate and a composition coated on at least that surface of the substrate on which emulsion layers are to be formed, and made of resin containing 50% by weight or more of said polyester and white pigment mixed and dispersed in the resin.

The polyester is one synthesized by polycondensation of dicarboxylic acid and diol. Preferred examples of dicarboxylic acid are terephthalic acid, isophthalic acid, naphthalenedicarboxylic acid. Preferred example of diol are ethylene glycol, butylene glycol, neopentyl glycol, triethylene glycol, butanediol, hexylene glycol, bisphenol A ethyleneoxide adduct (2,2-bis(4-(2-hydroxyethyloxy)phenyl)propane), 1,4-dihydroxymethylcyclohexane.

In the present invention, various polyesters, each obtained by polycondensation of dicarboxylic acids or mixtures thereof and diols or mixtures thereof, can be utilized. Of the dicarboxylic acids, at least one should preferably be terephthalic acid. A mixture of terephthalic acid and isophthalic acid (molar mixing ratio: 9:1 to 2:8) or a mixture of terephthalic acid and naphthalenedicarboxylic acid (molar mixing ratio: 9:1 to 2:8) is preferably use, too. It is desirable to use, as a diol, ethylene glycol or a mixture diol containing ethylene glycol. It is preferred that the polymer of these have a molecular weight of 30,000 to 50,000.

A plurality of these polyesters having different compositions are preferably used in the form of a mixture. Further, a mixture of these polyesters and any other resins can preferably be utilized. The other resins can be selected from various ones which can be extruded at 270° to 350° C. and which includes, for examples, polyolefins, such as polyethylene and polypropylene; polyethers, such as polyethylene glycol, polyoxymethylene and polyoxypropylene; polyester polyurethane; polyether polyurethane; polycarbonate; and polystyrene. One or more of these resins may be blended. For instance, 6% by weight of polyethylene and 4% by weight of polypropylene can be mixed with 90% by weight of polyethylene terephthalate. The ratio in which polyester and other resins are mixed varies, depending on the types of the resins. If the resins are polyolefins, an appropriate ratio of polyester to the other resins ranges from 100/0 to 80/20, which when exceeded will result in resin blend with very poor physical properties. If the resins are other than polyolefins, polyester can be mixed with other resins in a ratio ranging from 100/0 to 50/50. In the case where polyester is used in an amount less than 50% by weight, the effect of the present invention cannot be fully attained.

Pigments which can be cited as the white pigment mixed and dispersed in the polyester forming the reflective support according to the present invention are: for example, inorganic pigments, such as titanium oxide, barium sulfate, lithopone, aluminum oxide, calcium carbonate, silicon oxide, antimony trioxide, titanium phosphate, zinc oxide, white lead, and zirconium oxide; and organic fine powder pigments, such as polystyrene, and styrene-divinylbenzene copolymer.

Of these pigments, titanium dioxide works particularly effective when used. Titanium dioxide may either be a rutile titanium dioxide or an anatase titanium dioxide. It can be one which has been prepared by sulfate method or chloride method. Specific commercially available example are: KA-10 and KA-20, both manufactured by Titanium Kogyo Co., Ltd., A-220 manufactured by Ishihara Sangyo Co., Ltd, and the like.

The white pigment used in the present invention preferably has an average grain diameter of 0.1 to 0.8 μm. If the diameter is less than 0.1 μm, the pigment can hardly be uniformly mixed or dispersed in the resin. If the diameter is more than 0.8 μm, sufficient whiteness will not be attained and projections on the coated surface will form, impairing the image quality.

The weight ratio of the polyester to the white pigment which is mixed with the polyester is 98/2 to 30/70, preferably 95/5 to 50/50, and more preferably 90/10 to 60/40. If the content of the white pigment is less than 2% by weight, the pigment will contribute to the whiteness but insufficiently. If the content of the pigment exceeds 70% by weight, the photographic printing-paper support will be one which does not has a sufficient surface smoothness or a sufficient surface gloss.

The polyester and the white pigment are mixed and kneaded, together with a dispersing aid, for example, such as a metal salt of higher fatty acid, a higher fatty acid ethyl, a higher fatty acid amide, a higher fatty acid, by means of a two-roll kneader, a three-roll kneader, or a Banbury mixer. An antioxidant may be added or included in the resin layer, in an amount of 50 to 1,000 ppm in accordance with the resin.

The polyester-white pigment composition is coated on that surface of the substrate on which emulsion layers are to be formed, and applied to a thickness of 5 to 100 μm, preferably 5 to 80 μm, and more preferably 10 to 50 μm. If the thickness of the composition layer exceeds 100 μm, the layer may exhibit the problems on physical properties, such as cracking, due to the brittleness of the resin. If the thickness is less than 5 μm, the composition layer will lose its water-resistant, will fail to have both satisfactory whiteness and sufficient surface smoothness, and will be too soft with respect to physical properties.

The resin or the resin composition, which is coated on that surface of the raw paper on which no emulsion layers are to be formed, is a polyester, preferably a resin whose main component is polyethyleneterephthalate. The thickness of this resin or resin composition layer is preferably 5 to 100 μm, more preferably 10 to 50 μm. If its thickness exceeds the upper limit of the range, the layer may have the problems on physical properties, such as cracking, due to the brittleness of the resin. If its thickness is less than the lower limit of the range, the layer will have an insufficient whiteness and will be too soft with respect to physical properties.

The method for coating on that surface of the substrate on which emulsion layers are to be formed or not to be formed is, for example, the lamination method of a melt extrusion.

The substrate of the reflective support according to the present invention is selected from those which are generally used in preparing photographic printing paper. More specifically, the main material of the substrate is either synthetic pulp or natural pulp prepared from needle-leaved tree, broad-leaved tree or the like. If necessary, the main material may be added with: a filler, such as clay, talc, calcium carbonate, fine particles of urea resin, or the like; a sizing agent, such as rosin, alkylketene dimer, higher fatty acid, epoxydated fatty acid amide, paraffin wax, alkenylsuccinic acid, or the like; paper-reinforcing agent, such as starch, polyamidopoly-amine epichlorohydrin, polyacrylamide or the like; and a fixing agent, such as aluminium sulfate, cationic polymer, or the like.

The raw paper substrate are not limited to a particular type, nor is it limited to a specific thickness. However, it is desirable that the raw paper have a weighting capacity of 50 g/m$^2$ to 250 g/m$^2$. The raw paper should be surface-treated with heat or pressure by means of a machinecalender, a supercalender or the like, to ensure flatness and smoothness. The "smoothness" is used as a yardstick for the surface roughness of the support.

The surface roughness of the support according to the present invention will be described. The surface roughness is evaluated in terms of center-line average surface roughness. The roughness (SRa) is defined by the following Equation 1 and is represented by the unit of μm, when a center line is drawn in a center portion of the surface of the support, which has an area SM cut from a rough surface, setting an X and a Y axis on the center line, which intersect with ear other at right angles, and further setting a Z axis perpendicular to the center line.

$$SRa = \frac{1}{SM} \int_0^{L_X} \int_0^{L_Y} |f(X,Y)|\, dX dY \qquad \text{Equation 1}$$

where $L_X L_Y = SM$ $Z = f(X, Y)$

The center-line average surface roughness and the height of projections protruding from the center line can be determined by probing an area of 5 mm$^2$ with a diamond stylus having a diameter of 4 μm, and using a three dimensional surface roughness measuring machine (SE-30H) manufactured by Kosaka Kenkyusho Co., Ltd., set at cut-off value of 0.8 mm, horizontal magnification of 20, and vertical magnification of 2000. The measuring stylus is moved preferably at about 0.5 mm/sec. It is desirable that the supports have a value of 0.15 μm or less, more preferably 0.10 μm or less, as measured by this method. The use of a support having a low surface roughness (smoothness) provides a color print having a very smooth surface.

It is desirable that the raw paper be subjected to surface treatment, such as corona discharge treatment, flame treatment, undercoating or the like, before it is coated with the mixture composition of polyester and white pigment.

When polyester such as polyethyleneterephthalate is used, the support contacts photographic emulsions less firmly than when polyethylene is used. Therefore, it is preferable to melt extrusion laminate polyester onto the raw paper, then subject the surface of the resultant polyester layer to corona discharge treatment, and finally coat a hydrophilic colloid layer on the surface of the polyester layer.

It is also preferable to coat an undercoat solution containing a compound represented by the following formula [U], on the surface of the thermoplastic resin layer whose main component is polyester.

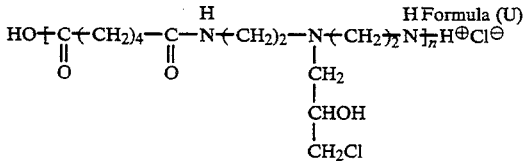

Formula (U)

n is an integer from 1 to 7

The coating amount of the compound represented by the formula [U] is preferably 0.1 mg/m$^2$ or more, more preferably 1 mg/m$^2$ or more, and most preferably 3 mg/m$^2$ or more. The greater the amount, the more firmly the compound can contact the resin. Nonetheless, an excessive use of the compound is disadvantageous from an economical point of view.

For the purpose of enhancing the readiness with which the undercoat solution can be coated on the surface of the resin layer, alcohols such as methanol or the like should be added to the solution. Alcohols are added in an amount of preferably 20% by weight or more, more preferably 40% by weight or more, and most preferably 60% by weight or more. In order to further improve the coating readiness of the solution, various preferred surfactants, such as an anionic one, a cationic one, an amphoteric one, a carbon fluoride-based one, an organic silicon-based one, and the like, are used.

Also, to provide a good undercoating surface, it is desirable to add a water-soluble high-molecular substance such as gelatin.

In view of the stability required of the compound represented by the formula [U], the pH of the undercoat solution is preferably 4 to 11, more preferably 5 to 10.

The surface of thermoplastic resin layer can be subjected to surface treatment, such as corona discharge treatment, flame treatment, plasma-processing or the like, before it is coated with the undercoat solution.

The undercoat solution can be applied by various coating methods generally known in the art. It can be coated by a gravure coater, a bar coater, a dip-coating method, an air-knife coating method, a curtain coating method, a roller coating method, a doctor coating method, an extrusion coating method, and the like.

The undercoat solution applied is dried preferably at 30° C. to 100° C., more preferably at 50° C. to 100° C., and most preferably at 70° C. to 100° C. The upper limit of the drying temperature is determined by the heat-resistance of the resin, and the lower limit thereof depends on the drying efficiency desired.

The pH value of the raw paper used in preparing the paper support of the light-sensitive material according to the present invention ranges from 5 to 9. It is more preferable that the pH value range from 5.5 to 8.5.

If the pH value of the raw paper exceed 9, the strength of the support may decrease or the fog density may increase, after the light-sensitive material is stored for a long period of time. The pH value of the raw paper should therefore be 9 or less.

In the present invention, the pH value of the raw paper is one measured in accordance with the hydrothermal extraction method of JIS-P-8133. The hydrothermal extraction method of JIS-P-8133 will be briefly explained in the following.

A test piece of about 1.0 g is measured out and put into a 100 ml Erlenmeyer flask. Then, 20 ml of distilled water is poured into the flask. The test piece is held in the water with a flat-tipped stirring rod until it is uniformly wetted and softened. Next, 50 ml of distilled water is added and stirred together with the distilled water previously poured into the flask. A cooling tube is connected to the flask. The flask is then placed in a hot-water bath, maintaining the contents of the flask at 95° to 100° C. without boiling the water in the flask. The contents are heated at this 10 temperature for one hour, while shaking the flask from time to time. Thereafter, the contents of the flask were cooled to 20±5 deg. The pH value of the extract solution is measured by using a glass-electrode pH meter.

The details of the measuring method and the instruments and devices used in the method accord with Japanese Industrial Standards of 1963.

Specific means for preparing the constitution of paper support for use in the present invention, and means for imparting a pH value of 5 to 9 to the paper support, will be described in the following.

The raw paper substrate for use in the paper support is made of paper manufactured mainly from wood pulp. The wood pulp may either be needle-leaved tree pulp or broad-leaved tree pulp. In the present invention, it is desirable to use short fiber of broad-leaved tree pulp in a large amount. More specifically, broad-leaved tree pulp should preferably make up 60% by weight or more of all the pulp used in forming the raw paper.

If necessary, a part of the wood pulp may be replaced by a synthetic pulp made of polyethylene and polypropylene or a synthetic fiber made of, for example, polyester, polyvinyl alcohol or nylon.

The freeness of all pulp used is preferably 150 to 500 cc in CSF specification, more preferably 200 to 400 cc. Preferably, the length of fibers of the pulp beat into pieces should be such that the 24×42 mesh residue in the definition of JIS-P-8207 takes up 40% by weight or less of all pulp.

A sizing agent is added internally to raw paper in general use. A sizing agent is added internally to the raw paper for use in the present invention, too. Since the paper support of the present invention needs to have a pH value ranging from 5 to 9, the sizing agent is preferably a neutral sizing agent such as epoxydated fatty acid amide, fatty acid anhydride, rosinic acid anhydride, alkenyl succinic anhydride, succin amide, isopropenylstearate, aziridine compound, or alkylketene dimer.

An agent for fixing the sizing agent is added internally to the raw paper in general use. A fixing agent is added internally to the raw paper for use in the present invention, too. Since the raw paper of the present invention needs to have a pH value ranging from 5 to 9, it is desirable that a neutral or weak alkaline compound such as cationic starch, polyamidopolyamine epichlohydrin, polyacrylamide, or a derivative of polyacrylamide be used in place of the sulfuric acid band (aluminum sulfate) which is usually used as a fixing agent, or that the sulfuric acid band be added and then neutralized.

Further, a filler, such as calcium carbonate, talc, clay, kaolin, titanium dioxide, or fine particles of urea resin may be added internally to the raw paper in order to enhance the smoothness of the raw paper.

If necessary, chemicals other than a sizing agent, a fixing agent and a filler may be added internally to the raw paper. Examples of these internal chemicals are: a paper-reinforcing agent, such as polyacrylamide, starch, polyvinyl alcohol, or the like; a softening agent, such as a product of reaction between maleic anhydride copolymer and polyalkylenepolyamine, or quaternary ammonium salt of higher fatty acid; a colored dye; and a fluorescent dye. In principle, internal chemicals having a pH value which is almost neutral should be used in order to set the pH value of the raw paper within the range of 5 to 9. If acidic or alkaline chemicals have to be used, they should preferably be used in as small an amount as possible.

The raw paper used to prepare a paper support can be manufactured by a long-net paper machine or a circular-net paper machine with the above-mentioned materials.

The weighting capacity of the raw paper is preferably 20 to 300 g/m$^2$, particularly 50 to 200 g/m$^2$. The thickness of the raw paper is preferably 25 to 350 μm, particularly 40 to 250 μm.

Further, to enhance the surface smoothness of the raw paper it is desirable to calender the paper by the on-machine calender or the super calender incorporated in the paper machine. Also desirable is that the density of the raw paper be changed by the calendering to the JIS-P-8118 definition of 0.7 to 1.2 g/m$^2$, preferably 0.85 to 1.10 g/m$^2$.

By virtue of the method of manufacturing the raw paper, especially by the use of the internal chemicals (i.e., the sizing agent, the fixing agent, and the like) and the use of the selected surface sizing agent, the pH value of the raw paper can be adjusted to 5 to 9.

In the light-sensitive material of the present invention, it is required that the ratio of the weight (g/m$^2$) of all hydrophilic colloid (solid component) coated on the support (i.e., on the surface on which light-sensitive emulsions are coated) to the weight (g/m$^2$) of all light-sensitive silver halide coated and contained in the light-sensitive material range from 5.0 to 30.0, more preferably from 6.0 to 20.0, and most preferably from 7.0 to 16.0.

The term "weight of all hydrophilic colloid coated on the support" means the weight of the solid component of the binder; coated on a unit area and contained in the light-sensitive and non-light-sensitive silver halide emulsion layers constituting the light-sensitive material. Generally, the hydrophilic colloid is gelatin. If gelatin is replaced by another hydrophilic colloid or used together with another hydrophilic colloid, the total weight of the solid components of these colloids coated on the unit area is regarded as the weight of "all hydrophilic colloid."

The term "weight (g/m$^2$) of all light-sensitive silver halide coated in the light-sensitive material" means the weight (g/m$^2$) of silver coated on the unit area and contained in the light-sensitive silver halide of all light-sensitive emulsion layers constituting the light-sensitive material. Hence, the weight of the black colloidal silver for preventing halation and that of the colloidal silver used as a filter are not included in this weight since both these colloidal silvers do not contribute to light-sensing.

In the present invention, if the above-mentioned ratio is less than 5.0, the coloring at the edges of the resultant color print will not be improved. If the ratio exceeds 30, the developing speed will be lowered, increasing the fluctuation of color density obtained within a predetermined time, and ultimately making it impossible to produce color prints of a constant quality at high speed.

The color light-sensitive material of the present invention can be made by coating at least one yellow-coloring silver halide emulsion, at least one magenta-coloring silver halide emulsion, and at least one cyan-coloring silver halide emulsion, on a support having a reflective layer. With an ordinary color photographic printing paper, it is possible to reproduce colors by subtractive color process if each silver halide emulsion contains a color coupler which produces a dye of the color complementary to the color of the light to which the emulsion is sensitive. In the ordinary color photographic printing paper, the grains in the yellow-coloring silver halide emulsion are spectrally sensitized with a blue-sensitive spectral sensitizer, the grains in the magenta-coloring silver halide emulsion are spectrally sensitized with a green-sensitive spectral sensitizer, and the grains in the cyan-coloring silver halide emulsion are spectrally sensitized with a red-sensitive spectral sensitizer. Furthermore, in the ordinary color photographic printing paper, the emulsions may be coated in the order mentioned above, or in a different order according to the desired objective. To increase the processing speed, a light-sensitive layer containing silver halide grains having a largest average size should better be the uppermost layer. And to enhance the stability of the printing paper kept exposed to light, the magenta-coloring light-sensitive layer should be the lowermost.

The light-sensitive layers and their coloring hues may not correspond exactly to the aforementioned. For instance, at least one layer of an infrared-sensitive silver halide emulsion can be used.

In the present invention, it is necessary to use, as silver halide grains, silver chloride grains, silver chlorobromide grains containing 95 mol % or more of silver chloride, or silver chloroiodobromide grains containing 95 mol % or more of silver chloride. In particular, it is preferable to use silver chloride or silver chlorobromide containing substantially no silver iodide in order to shorten the time required for processing. The phrase "containing substantially no silver iodide" means that the silver iodide content is 1 mol % or less, preferably 0.2 mol % or less. In some case, high-silver chloride grains containing 0.01 to 3 mol % of silver iodide may be used as described in JP-A-3-84545, for the purpose of enhancing the high illumination sensitivity, spectral sensitization sensitivity, or aging stability of the light-sensitive material. The halogen composition of each emulsion may differ or identify among the grains. When an emulsion whose halogen composition is identical for every grain is used, it is easy to make the grains homogenous in their properties. Grains which differ in distribution of halogen composition may be selected and used, if necessary. Among these grains are: so-called uniform-structure grains in which each grain is homogenous in composition to another; so-called multi-layered grains in which each grain is formed of a core having a composition and at least one shell surrounding the core and having a different composition; and grains in which each grain has non-layered portions of different halogen compositions within or on the surface (if existing on the grain surface, the non-layer portions are Joined at the edges, corners or surfaces). To attain high sensitivity, it is better to use the latter two types of grains, rather than uniform-structure grains. The latter two types of grains are preferred in view of pressure resistance. If the silver halide grains used are either of the first type mentioned or the second type mentioned, the portions differing in halogen composition may have distinct boundaries or indistinct boundaries. The portions of different compositions may form a mixed crystal. Alternatively, each grain of the latter two types may have a continuously changing composition.

Preferably, the high-silver chloride emulsions contain silver halide grains having a layered or non-layered localized phase of silver bromide on the surface and/or inside thereof. These localized phases have a halogen composition such that its silver bromide content is preferably at least 10 mol %, more preferably exceeding 20 mol %. Silver bromide content of each localized phase can be analyzed by means of X-ray diffraction method or the like. (The X-ray diffraction method is described in, for example, Japan Chemistry Society, "New Experimental Chemistry Lecture 6: Structure Analysis," Maruzen.) These localized phases may exist within the grains, at the edges of the grains, at the corners thereof, or on the surfaces thereof. One desirable example is one which has epitaxially grown on a corner of the grain.

The rate of replenishing the developing solution can be effectively reduced by further increasing the silver chloride content of the silver halide emulsions. In this case, the preferably used emulsions are ones containing silver halide which is almost exclusively silver chloride, that is, containing 98 mol % to 100 mol % of silver chloride.

The average size of the silver halide grains contained in the silver halide emulsions used in the present invention is preferably 0.1 μm to 2 μm. (The term "average size" means the arithmetic mean of the sizes of the individual grains, each grain size is the diameter of a circle equivalent to the projected area of the individual grain.)

It is desirable that these grains be so-called monodisperse ones which have a size distribution in terms of a variation coefficient of 20% or less, preferably 15% or less, and more preferably 10% or less. ("Variation coefficient" is a value obtained by dividing the standard deviation of grain size by the average grain size.) In order to impart a broad latitude to the light-sensitive material, it is preferable to use the monodisperse emulsions blended together in the same layer or used in the multilayers formed one upon another.

The sharp of silver halide grains contained in the photographic emulsion may have regular crystals, such as cubic, octahedral, or tetradecahedral crystals, or irregular crystals, such as spherical crystals and tabular crystals, or a mixture of regular and irregular crystals. Furthermore, the grains may consist of a mixture of grains having various crystal shapes. In the present invention it is desirable that 50% or more, preferably 70% or more, and more preferably 90% or more of the grains be those having regular shapes.

In addition, other emulsions occupying which tabular grains having an aspect ratio (i.e, the equivalent-sphere diameter/thickness ratio) of 5 or more, preferably 8 or more, occupy 50% or more to the projected area of all grains contained can be used.

The silver bromide (iodide) emulsions used in the present invention can be prepared with methods described in, for example, P. Glafkides, "Chemie et Phisique Photographique", Paul Montel, 1967, G. F. Duffin, "Photographic Emulsion Chemistry", Focal Press, 1966, and V. L. Zelikman et al., "Making and Coating Photographic Emulsion", Focal Press, 1964. Specifically, they can be prepared with an acid method, neutral method, or ammonia method. To react a soluble silver salt and a soluble halogen salt, any of a single-jet method, a double-jet method, or a combination of these methods can be used. Also, a method (known as "reverse double-jet method") may be employed in which grains are formed in the presence of excess silver ions. As one type of the double-jet method, the so-called controlled double-jet method may be used, in which pAg in the silver halide-forming liquid phase is formed is maintained at a constant value. This method can produce a silver halide emulsion containing grains which have a regular shape and which are nearly uniform in size.

The emulsions used in the present invention are of so-called surface latent-image type in which a latent image is mainly formed on the surface of each grain.

The localized phases in silver halide grains or the substrate of the phase should contain ions of different metals or complex ions thereof. The preferred of these ions are: ions of the VIII group and IIb group metals of the periodic table, ions of the complexes of these metals, lead ions, and thallium ions. In these localized phases, ions of iridium, rhodium or iron, or complex ions thereof may be used in combination. In the substrate of the phase, ions of osmium, iridium, rhodium, platinum, ruthenium, palladium, cobalt, nickel or iron, or complex ions thereof may be used in combination. It is possible to use ions of a metal in a specific concentration in the phase, and ions of a different metal in a different concentration in the localized phase or the substrate. Furthermore, these metals may consist of a mixture of metals. It is particularly desirable that an iron compound and an iridium compound exist in the localized phase of silver bromide.

These compounds providing metal ions are made to exist in the localized phase of silver halide grains in the present invention and/or the other portion of grains (i.e., substrate), by dissolving them into the gelatin aqueous solution, halide aqueous solution, silver salt aqueous solution or other aqueous solution used as a dispersant, or by adding the fine grains of silver halides containing metal ions to such an aqueous solution and then dissolving these fine grains in the solution during the formation of the silver halide grains.

The metal ions used in the present invention may be contained in the emulsion grains before the grains are formed, while the grains are being formed, or immediately after the grains have been formed. The timing of when the metal ions must be introduced into each grain is determined in accordance with where in the grain the ions should be located.

The silver halide emulsions used in the present invention are generally subjected to chemical sensitization and spectral sensitization.

Various methods of the chemical sensitization may be performed, among which are chemical sensitization using a chalcogen sensitizer (Specific examples are: sulfur sensitization, selenium sensitization and tellurium sensitization which are achieved by adding an unstable sulfur compound, a selenium compound, and a tellurium compound, respectively), noble metal sensitization such as gold sensitization, or reduction sensitization. The use of one or more different sensitizing methods is preferable. Preferred compounds used in the chemical sensitization are those described in JP-A-62-215272, page 18, lower-right column to page 22, upper-right column.

In the selenium sensitization performed in the present invention, unstable selenium compounds are used. The unstable selenium compounds described in, for example, JP-B-43-13489, JP-B-44-15748, JP-A-4-25832, JP-A-4-109240, JP-A-4-271341, and EP 0506009A1 can be used.

More specifically, some examples of unstable selenium compounds which may be used are: colloidal metal selenium, selenoureas (e.g., N,N-dimethylselenourea, trifluromethylcarbonyl-trimethylselenourea, and acetyl-trimethylselenourea), selenoamides (e.g., selenoacetoamide and N,N-diethylpheneylselenoamide), phosphinselenides (e.g., triphenylphosfinselenide and pentafluorophenyl-triphenylphosfinselenide), selenophosphates (e.g., tri-p-tolylselenophosphate and tri-n-butylselenophosphate), selenoketones (e.g., selenobenzophenone), isoselenocyanates, selenocarboxylic acids, selenoesters, and diacylselenides. Furthermore, stable selenium compounds described in JP-B-46-4553 and JP-B-52-34492, such as selenious acid, potassium selenocyanate, selenazoles, and selenides, can be utilized.

Unstable tellurium compounds are used in the tellurium sensitization. The unstable tellurium compounds described in, for example, Canadian Patent No. 800,958, British Patent No. 1,295,462, British Patent No. 1,396,696, JP-A-4-204640, JP-A-4-271341, JP-A-333043, and EP 0567151A1, and be used.

More specifically, the following may be used: tellurourea (e.g., tetramethyltelluourea, N,N'-dimethylethylenetellurourea, and N,N'-diphenylethylenetellurourea), phosphintellurides (e.g., butyl-diisopropylphosphintelluride, tributylphosphintelluride, tributoxyphosphintelluride, and ethoxy-diphenylphosphintelluride), diacyl(di)tellurides (e.g., bis(diphenylarbamoyl)ditelluride, bis(N-phenyl-N-methy-carbamoyl)ditelluride, bis(N-phenyl-N-methylcarbamoyl)telluride, and bis(ethoxycarbonyl)telluride), isotellurocyanates, telluroamides, tellurohydrazines, telluroesters (e.g., butylhexyltelluroester), telluroketones (e.g., telluroacetophenone), colloidal tellurium, (di)tellurides, and other tellurium compounds (e.g., potassium telluride, sodium telluropentathionate.

As sensitizers for gold sensitization, the gold compounds described in, for example, U.S. Pat. Nos. 2,642,361, 5,049,484, and 5,049,485 can be used, in addition to, for example, chloroauric acid, potassium chloroaurate, potassium aurithiocynate, gold sulfide, and gold selenide.

These chemical sensitizations can be performed either individually or in combination. It is also preferable to perform the chemical sensitization together with the sulfur sensitization and/or the reduction sensitization.

It is desirable that either tellurium sensitization or gold sensitization be employed in the present invention.

In the present invention, the selenium sensitizer and the tellurium sensitizer are used in an amount of about $10^{-8}$ to $10^{-2}$ mol, preferably about $10^{-7}$ to $5\times10^{-3}$ mol per mol of silver halide, depending upon the type of the silver halide grains used and the conditions of the chemical sensitization.

In the present invention, the gold sensitizer is used in an amount of about $10^{-7}$ to $10^{-2}$ mol, per mol of silver halide.

Conditions in which to perform the chemical sensitization in the present invention are not particularly restrictive, but the pAg value should be 5 to 9, preferably 6 to 8.5, the pH value should be 4 to 10, and the temperature should be 40° to 95° C., preferably 45° to 85° C.

To introduce the compounds represented by the Formula (I), the Formula (II), and the Formula (III) into the silver halide emulsion layers, they may be dispersed directly into the emulsions, or by first dissolving them in a solvent such as water or methanol or in a mixture of such solvents and then added the resultant solution to the emulsions. The compounds may be added to the emulsions at any time after the preparation of the emulsions and before the coating thereof. Nonetheless, it is desirable that they be added at the time of preparing the coating solutions. Preferably, the compounds represented by the Formula (I), the Formula (II) and the Formula (III) are added in an amount of $1\times10^{-5}$ to 1 mol per mol of silver halide, more prefer ably $1\times10^{-3}$ to $5\times10^{-1}$ mol per mol of silver halide.

The compound represented by the Formula (I) will now be described in more detail.

Formula (I)

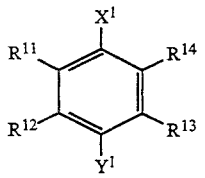

In this Formula (I), $X^1$ and $Y^1$ independently represent a hydroxyl group, —$NR^{15}R^{16}$, or —$NHSO_2R^{17}$, $R^{11}$, $R^{12}$ $R^{13}$ and $R^{14}$ independently represent a hydrogen atom or any given substituent group. The given substituent group is, for example, an alkyl group (preferably one having 1 to 20 carbon atoms, such as methyl, ethyl, octyl, hexadecyl, or t-butyl), an aryl group (preferably one having 6 to 20 carbon atoms, such as phenyl or p-tolyl), an amino group (preferably one having 0 to 20 carbon atoms, such as amino, diethylamino, diphenylamino, or hexadecylamino), an amido group (preferably one 1 to 20 carbon atoms, such as acetylamino, benzoylamino, octadecanoylamino, or benzenesulfonamido), an alkoxy group (preferably one having 1 to 20 carbon atoms, such as methoxy, ethoxy, or hexadecyloxy), an alkylthio group (preferably one having 1 to 20 carbon atoms, such as methylthio, butylthio, or octadecylthio), an acyl group (preferably one having 1 to 20 carbon atoms, such as acetyl, hexadecanoyl, benzoyl, or benzenesulfonyl), a carbamoyl group (preferably one having 1 to 20 carbon atoms, such as carbamoyl, N-hexylcarbamoyl, or N,N-diphenylcarbamoyl), an alkoxycarbonyl group (preferably one having 2 to 20 carbon atoms, such as methoxycarbonyl or octyloxycarbonyl), a hydroxyl group, a halogen atom (e.g., F, Cl, or Br), a cyano group, a nitro group, a sulfo group, or a carboxyl group. The given substituent group may be substituted with another substituent group (e.g., one recited as $R^{11}$).

In the Formula (I), $R^{11}$ and $R^{12}$, and $R^{13}$ and $R^{14}$ may be bonded to each other to form a carbon ring respectively. The rings are preferably 5- to 7-membered ones. $R^{15}$ and $R^{16}$ independently represent a hydrogen atom, an alkyl group (preferably one having 1 to 10 carbon atoms, such as ethyl, hydroxyethyl, or octyl), an aryl group (preferably one having 6 to 10 carbon atoms, such as phenyl or naphtyl), or a heterocyclic group (preferably one having 2 to 10 carbon atoms, such as 2-furanyl or 4-pyridyl). The given substituent group may be substituted with another substituent group (e.g., one recited as R''). $R^{15}$ and $R^{16}$ may be bonded to each other to form a nitrogen-containing heterocyclic ring (preferably a 5- to 7-membered one). $R^{17}$ represents an alkyl group (preferably one having 1 to 20 carbon atoms, such as ethyl, octyl, or hexadecyl), an aryl group (preferably one having 6 to 20 carbon atoms, such as phenyl, p-tolyl, or 4-dodecyloxyphenyl), an amino group (preferably one having 0 to 20 carbon atoms, such as N,N-diethylamino, N,N-diphenylamino, or morpholino), or a heterocyclic group (preferably one having 2 to 20 carbon atoms, such as 3-pyridyl). These may further be substituted.

In the Formula (I), $X^1$ is preferably —$NHSO_2R^{17}$, and each of $R^{11}$, $R^{12}$, $R^{13}$, and $R^{14}$ is preferably a hydrogen atom, an alkyl group, an amido group, a halogen atom, a sulfo group, or a carboxyl group.

The compound represented by the Formula (II) will now be described in greater detail.

Formula (II)

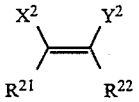

In this Formula (II), $X^2$ and $Y^2$ independently represent a hydroxyl group, —$NR^{23}R^{24}$, or —$NHSO_2R^{25}$, and $R^{21}$ and $R^{22}$ independently represent a hydrogen atom or any given substituent group. The given substituent group is, for example, one recited as $R^{11}$. $R^{21}$ and $R^{22}$ may be bonded to each other to form a carbon ring or a heterocyclic ring (preferably, either being a 5- to 7-membered ring). $R^{23}$ and $R^{24}$ independently represent a hydrogen atom, an alkyl group, an aryl group, or a heterocyclic group, specific examples of which are the same as those exemplified above as $R^{15}$. $R^{23}$ and $R^{24}$ may be bonded to each other to form a nitrogen-containing heterocyclic ring (preferably a 5- to 7-membered one). $R^{25}$ represents an alkyl group, an aryl group, an amino group, or a heterocyclic group, specific examples of which are the same as those exemplified above as $R^{17}$.

In the Formula (II), $X^2$ is preferably —$NR^{23}R^{24}$, or —$NHSO_2R^{25}$, and each of $R^{21}$, and $R^{22}$ is preferably a hydrogen atom, an alkyl group, an aryl group. $R^{21}$ and $R^{22}$ may preferably be bonded to each other to form a carbon ring or a heterocyclic ring. These group, specific examples of which are same as those exemplified above as $R^{15}$.

The compound represented by the Formula (III) will be described in more detail.

Formula (III)

$$- d^{\sim}{*}FZ - e^{\sim} + Md^{\sim},G \quad R^{31}(Y^3)_nNH-X^3$$

In this Formula (III), $X^3$ represents a hydroxyl group or —$NR^{32}R^{33}$, $Y^3$ represents a —CO— or —$SO_2$—; $R^{31}$ represents a hydrogen atom or any given substituent group (e.g., one recited as $R^{11}$), and n is 0 or 1.

In the Formula (III), $R^{32}$ and $R^{33}$ independently represent a hydrogen atom, an alkyl group, an aryl group, or a heterocyclic group, specific examples of which are the same as those exemplified above as $R^{15}$. $R^{31}$ and $R^{32}$, and $R^{32}$ and $R^{33}$ may be bonded to each other to form a heterocyclic ring, respectively, too. (These rings are preferably 5- to 7-membered ones.)

Preferably, in the Formula (III), $X^3$ preferably represents —$NR^{32}R^{33}$, and $Y^3$ preferably represents —CO—. $R^{31}$ is preferably a hydrogen atom, an alkyl group, an aryl group, an alkoxy group, an aryloxy group, or an amino group. These may be further substituted with any given substituent group (for example, one recited as $R^{11}$). Preferably, $R^{32}$ and $R^{33}$ independently represent a hydrogen atom or an alkyl group.

Examples of the compounds represented by the formula (I), the formula (II) and the formula (III) will be specified in the following. Nevertheless, compounds which can be used in this invention are not limited to these.
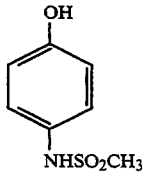
(I)-1
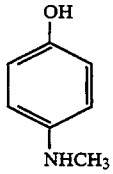
(I)-2
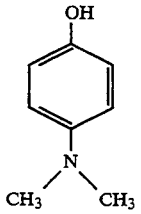
(I)-3
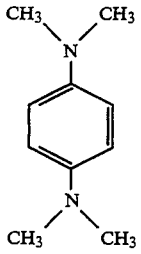
(I)-4
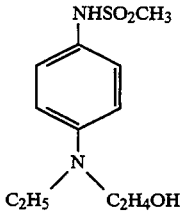
(I)-5
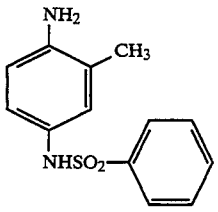
(I)-6
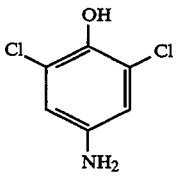
(I)-7
-continued
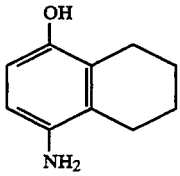
(I)-8
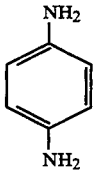
(I)-9
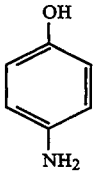
(I)-10
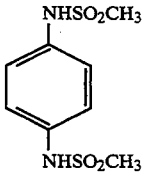
(I)-11
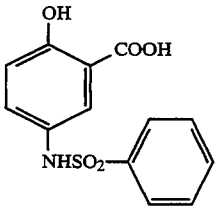
(I)-12
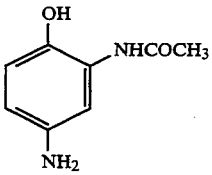
(I)-13
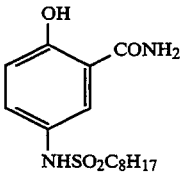
(I)-14
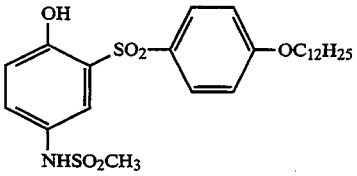
(I)-15
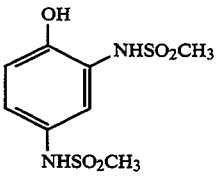
(I)-16

-continued
(II)-1
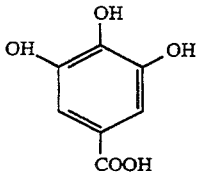
(II)-2
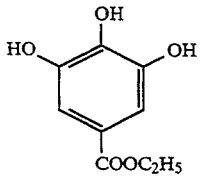
(II)-3
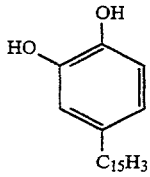
(II)-4
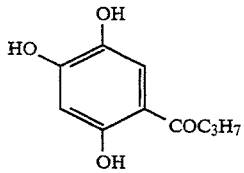
(II)-5
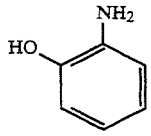
(II)-6
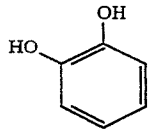
(II)-7
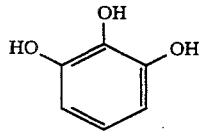
(II)-8
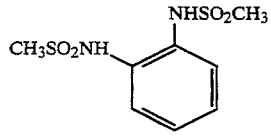
(II)-9
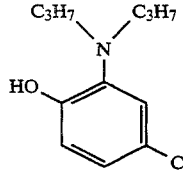
-continued
(II)-10
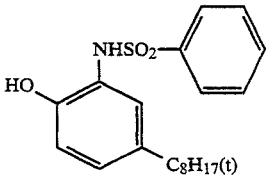
(II)-11
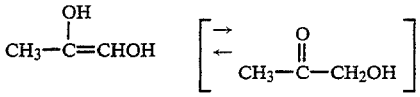
(II)-12
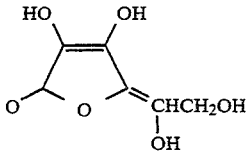
(II)-13
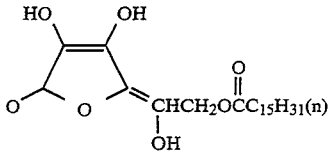
(II)-14
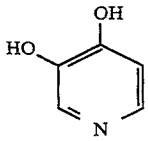
(II)-15
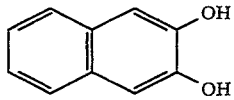
$NH_2NH_2$ (III)-1
(III)-2
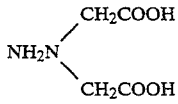
$CH_3CONHNH_2$ (III)-3
(III)-4
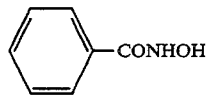
(III)-5
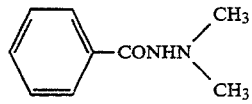
$NH_2CONHNH_2$ (III)-6
(III)-7
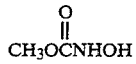
(III)-8
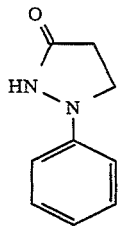

-continued (III)-9

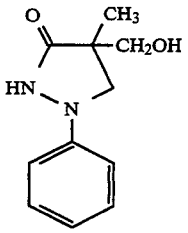

(III)-10

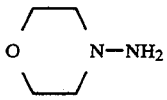

(III)-11

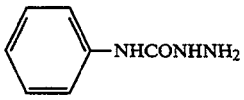

(III)-12

$NH_2NHCONHNH_2$ (III)-13

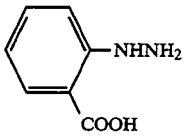

(III)-14

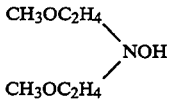

(III)-15

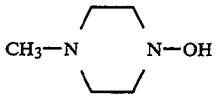

(III)-16

$CH_3NHNHCH_3$ (III)-17

$(t)C_4H_9NHOH$ (III)-18

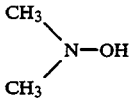

(III)-19

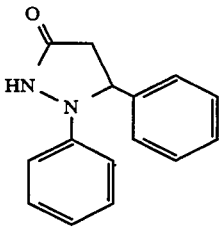

(III)-20

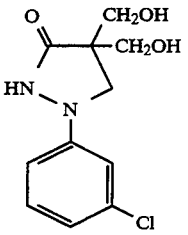

-continued (III)-21

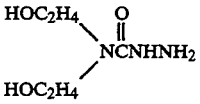

(III)-22

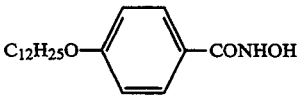

(III)-23

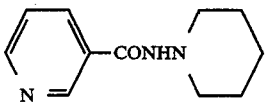

(III)-24

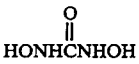

(III)-25

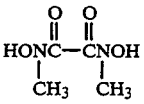

(III)-26

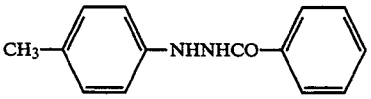

(III)-27

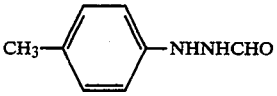

Preferable as mercapto heterocyclic compounds used in the present invention are those represented by the following Formula (IV):

Formula (IV)

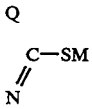

In this Formula (IV), Q is a 5- or 6-membered heterocyclic ring or a group of atoms required for forming a 5- or 6-membered heterocyclic ring with the benzene ring being condensated, and M represents a cation.

The compound represented by the Formula (IV) will be described in detail in the following.

Rings which can be recited as the heterocyclic ring represented by Q are, for example, an imidazole ring, a tetrazole ring, a thiazole ring, an oxazole ring, a selenazole ring, a benzoimidazole ring, a naphthoimidazole ring, a benzothiazole ring, a naphthothiazole ring, benzoselenazole ring, a naphthoselenazole ring, and a benzoxyzole ring.

Cations which can be recited as the cation represented by M are, for example, a hydrogen atom, an alkali metal (e.g., sodium or potassium), and an ammonium group.

Preferable compounds represented by the Formula (IV) as the mercapto compounds are represented by the following Formulas (IV-1), (IV-2), (IV-3), and (IV-4):

Formula (IV-1)

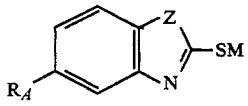

In this Formula (IV-1), $R_A$ represents a hydrogen atom, an alkyl group, an alkoxy group, an aryl group, a halogen atom, a carboxyl group, a salt thereof, a sulfo group, a salt thereof, or an amino group, Z represents —NH—, —O—, or —S—, and M has the same meaning as the M in the Formula (IV).

Formula (IV-2)

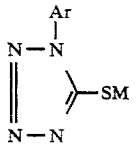

In this Formula (IV-2), $R_A$ represents following:

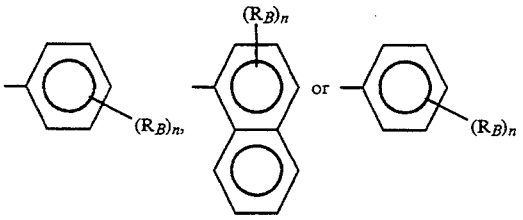

$R_B$ is an alkyl group, an alkoxy group, a carboxyl group, a salt thereof, a sulfo group, or a salt thereof, a hydroxyl group, an acyl group, an acylamino group, a carbamoyl group, or a sulfonamido group, n represents an integer of from 0 to 2, and M has the same meaning as in the Formula (IV).

In the Formulas (IV-1) and (IV-2), the alkyl groups represented by $R_A$ and $R_B$ are each, for example, methyl, ethyl, or butyl. The alkoxy group is, for example, methoxy or ethoxy. The salt of the carboxyl group or the sulfo group is, for example, sodium salt or ammonium salt.

In the Formula (IV-1), the aryl group represented by $R_A$ is, for example, phenyl or naphtyl, and the halogen atom is, for example, a chlorine atom or a bromine atom. In the Formula (IV-2), the acylamino group represented by $R_B$ is, for example, methylcarbonylamino or benzoylamino, the carbamoyl group is, for example, ethylcarbamoyl or phenylcarbamoyl, and the sulfonamido group is, for example, methylsulfonamido or phenylsulfonamido.

The alkyl group, alkoxy group, aryl group, amino group, acylamino group, carbamoyl group and sulfonamino group, all specified above, include those having a substituent group. The amino group, for example, may be one substituted for an alkylcarbamoyl group, namely an alkyl-substituted ureido group.

Formula (IV-3)

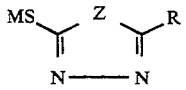

In this Formula (IV-3), Z represents —N($R_{A1}$)—, an oxygen atom, or a sulfur atom, and R represents a hydrogen atom, an alkyl group, an aryl group, an alkenyl group, a cycloalkyl group, —$SR_{A1}$—, —N($R_{A2}$)$R_{A3}$, —NHCO$R_{A4}$, —NHS$O_2R_{A5}$, or a heterocyclic ring, where $R_{A1}$ represents a hydrogen atom, an alkyl group, an alkenyl group, a cycloalkyl group, an aryl group, —$COR_4$, or —$SO_2R_{A5}$, $R_{A2}$ and $R_{A3}$ independently represents a hydrogen atom, an alkyl group, or an aryl group, and $R_{A4}$ and $R_{A5}$ independently represent an alkyl group or an aryl group. M has the same meaning as in the Formula (IV).

Alkyl groups which can be cited as R, $R_{A1}$, $R_{A2}$, $R_{A3}$, $R_{A4}$, and $R_{A5}$ in the Formula (IV-3) are, for example, methyl, benzyl, ethyl, and propyl. Aryl groups which can exemplified as R, $R_{A1}$, $R_{A2}$, $R_{A3}$, $R_{A4}$, and $R_{A5}$ are, for example, phenyl and naphtyl.

An alkenyl group which can be specified as R or $R_{A1}$ is, for example, propenyl. A cycloalkyl group which can be cited as R or $R_{A1}$ is, for example, cyclohexyl. Heterocyclic groups which can be specified as R are, for example, furyl and pyridyl.

The alkyl group and the aryl group independently represented by R, $R_{A1}$, $R_{A2}$, $R_{A3}$, $R_{A4}$, or $R_{A5}$, and the alkenyl group and the cycloalkyl group independently represented by R or $R_{A1}$, and the heterocyclic group represented by R may include those having a substituent group.

Formula (IV-4)

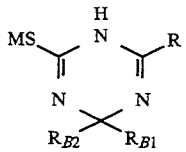

In this Formula (IV-4), R and M are of the same meaning as in the Formula (IV-3), $R_{B1}$ and $R_{B2}$ represent groups identical to those of $R_{A1}$ and $R_{A2}$ in the Formula (IV-3), respectively.

Examples of the compounds represented by the Formula (IV) will be specified in the following. Nevertheless, compounds which can be used in this invention are not limited to these.

IV-1-1

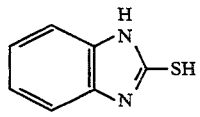

IV-1-2

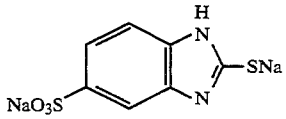

-continued
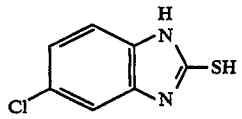
IV-1-3
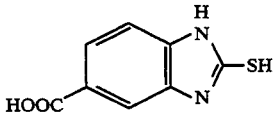
IV-1-4
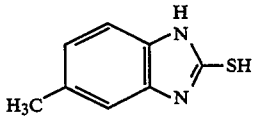
IV-1-5
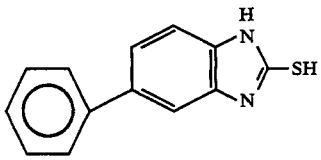
IV-1-6
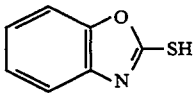
IV-1-7
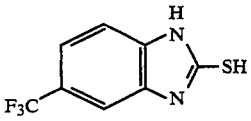
IV-1-8
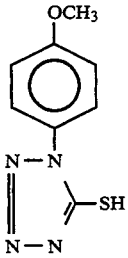
IV-2-1
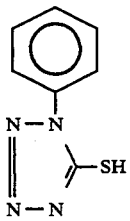
IV-2-2
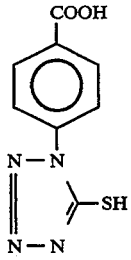
IV2-3

-continued
IV-2-4
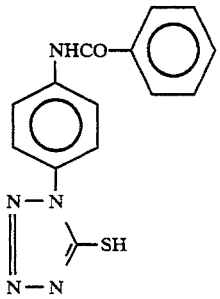
IV-2-4
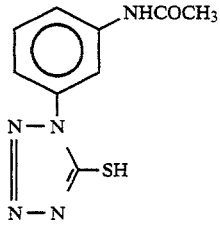
IV2-6
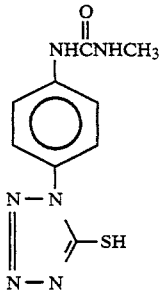
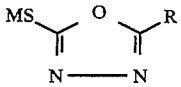
| Exemplified Compound | R | M |
|---|---|---|
| IV-3-1 | $-C_2H_5$ | —H |
| IV-3-2 | $-CH_2-CH-CH_2$ | —H |
| IV-3-3 | $-CH=CH-CH_2-CH_3$ | —H |
| IV-3-4 | $-C_7H_{15}$ | —H |
| IV-3-5 | $-C_9H_{19}$ | —Na |
| IV-3-6 | 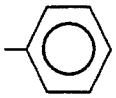 | —H |
| IV-3-7 | $-C_4H_9(t)$ | —H |
| IV-3-8 | 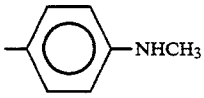 | —H |
| IV-3-9 | 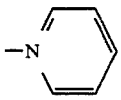 | —H |
| IV-3-10 | 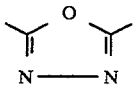 | —H |

-continued
| | | |
|---|---|---|
| IV-3-11 | 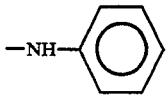 | —H |
| IV-3-12 | 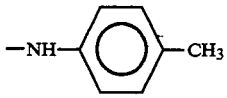 | —$HN_4$ |
| IV-3-13 | —$NHCOCH_3$ | —H |
| IV-3-14 | 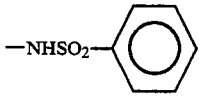 | —H |
| IV-3-15 | —$N(CH_3)_3$ | —H |
| IV-3-16 | 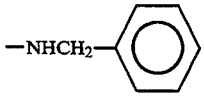 | —H |
| IV-3-17 | 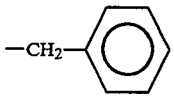 | —H |
| IV-3-18 | —S—$CH_3$ | —H |
| IV-3-19 | 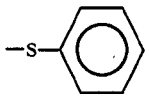 | —H |
| IV-3-20 | —SH | —H |
| IV-3-21 | —H | —H |
| IV-3-22 | —$C_2H_5$ | —H |
| IV-3-23 | —$C_4H_9$(t) | —H |
| IV-3-24 | —$C_6H_{13}$ | —H |
| IV-3-25 | 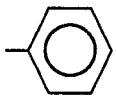 | —H |
| IV-3-26 | 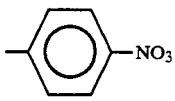 | —H |
| IV-3-27 | 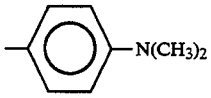 | —H |
| IV-3-28 | 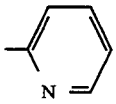 | —H |
| IV-3-29 | 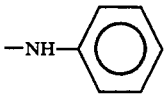 | —H |
| IV-3-30 | —$NH_2$ | —H |
| IV-3-31 | —$CH_2CH{=}CH_2$ | —H |
| IV-3-32 | —SH | —H |
| IV-3-33 | —$NHCOC_2H_5$ | —H |

-continued
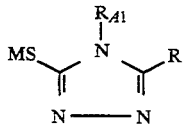
| Exemplified Compound | R | $R_{A1}$ | M |
|---|---|---|---|
| IV-3-34 | $-C_2H_5$ | $-H$ | $-H$ |
| IV-3-35 | $-CH_3$ | $-CH_3$ | $-H$ |
| IV-3-36 | $-CH_3$ | 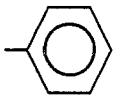 | $-H$ |
| IV-3-37 | $-NHCOCH_3$ | $-CH_3$ | $-H$ |
| IV-3-38 | 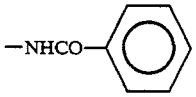 | 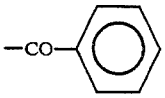 | $-H$ |
| IV-3-39 | $-NHCOCH_3$ | $-COCH_3$ | $-H$ |
| IV-3-40 | $-NHCOCH_3$ | 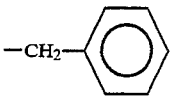 | $-H$ |
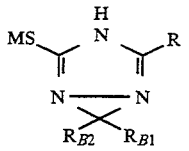
| Exemplified Compound | R | $R_{B1}$ | $R_{B2}$ | M |
|---|---|---|---|---|
| IV-4-1 | $-C_2H_5$ | $-CH_3$ | $-CH_3$ | $-H$ |
| IV-4-2 | 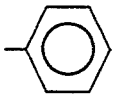 | $-CH_3$ | $-CH_3$ | $-H$ |
| IV-4-3 | $-NH_2$ | $-H$ | 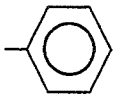 | $-H$ |
| IV-4-4 | 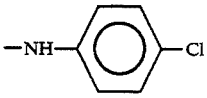 | $-CH_3$ | $-C_4H_9$ | $-H$ |
| IV-4-5 | $-NHCOCH_3$ | $-CH_3$ | $-CH_3$ | $-H$ |
| IV-4-6 | 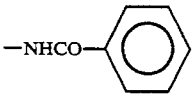 | $-CH_3$ | $-CH_3$ | $-H$ |
| IV-4-7 | 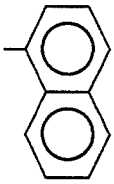 | $-CH_3$ | $-C_3H_7(i)$ | $-H$ |

-continued

IV-4-8

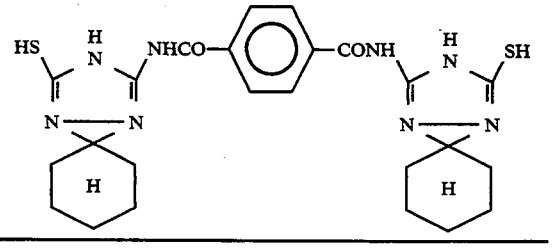

The compound represented by the Formula (IV) is added, preferably in an amount of $1\times10^{-5}$ to $5\times10^{-2}$ mol per mol of silver halide, more preferably in an amount of $1\times10^{-4}$ to $1\times10^{-2}$ mol per mol of silver halide. There is no constraint as to when the compound may be added. The compound may be added during the forming of silver halide grains, during the physical ripening, during the chemical ripening, or during the adjusting of the coating solution.

The advantages of the light-sensitive material according to the present invention are more distinctive in the case where gold-sensitized, high-silver chloride emulsions are utilized.

Various compounds and precursors thereof can be added to the silver halide emulsions used in the present invention in order to prevent fog from occurring while the light-sensitive material is being manufactured, stored, or processed. Specific examples of these compounds disclosed in JP-A-62-215272, pages 39 to 72 are preferably used. Also, 5-arylamino-1,2,3,4-thiatriazole compound described in EP-0,447,647 (having at least one electron attractive group at the aryl residual group) can be used.

Spectral sensitization is performed for the purpose of imparting spectral sensitivity to the emulsion for each layer in the light-sensitive material of the present invention, so that the emulsion may be sensitive to a desired wavelength region of light.

Spectral sensitizing dyes, which can be recited as those used to effect blue-, green- and red-region spectral sensitization in the light-sensitive material of the present invention, are, for example, the dyes which are described in F. M. Harmer, "Heterocyclic Compounds-Cyanine Dyes and Related Compounds", John Wiley & Sons, New York, London, 1964. The specific examples of these compounds, and the spectral sensitization method, which are described in JP-A-62-215272, page 22, upper-right column to page 38, are preferably utilized. In particular, in view of its stability, adsorbability, and temperature-dependency of exposure, the spectral sensitizing dye disclosed in JP-A-3-123340 is very much preferable as a red-sensitive spectral sensitizing dye for silver halide emulsion grains which have a high silver chloride content.

In order to perform a infrared-region spectral sensitization with high efficiency in the light-sensitive material of the present invention, the sensitizing which are preferably used are dyes described in JP-A-3-15049, page 12, upper-left column to page 21, lower-left column, JP-A-3-20730, page 4, lower-left column to page 15, lower-left column, EP-0,420,011, page 4, line 21 to page 6, line 54, EP-0,420,012, page 4, line 12 to page 10, line 33, EP-0,443,466, and U.S. Pat. No. 4,975,362.

To introduce these spectral sensitizing dyes into the silver halide emulsions, the dyes may be dispersed directly into the emulsions, or they may be first dissolved in a solvent, such as water, methanol, ethanol, propanol, methyl cellosolve, 2,2,3,3-tetrafluoropropanol, or the like, or in a mixture of such solvents and then added as the resultant solution to the emulsions. Alternatively, the dyes may be dissolved together with an acid or a base in water, thus forming an aqueous solution which may be added to the emulsions, as is described in JP-B-44-23389, JP-B-44-27555, JP-B-57-22089, and the like. As a further alternative, the dyes may be dissolved together with a surfactant, thus forming an aqueous solution or a colloidal dispersion, and the solution or the dispersion may then be added to the emulsions, as is described in U.S. Pat. No. 3,822,135, U.S. Pat. No. 4,006,025, and the like. Also, the dyes may be dissolved in a solvent, such as phenoxyethanol, which substantially does not mix with water, then be dispersed into water or hydrophilic colloid, thereby forming a dispersion which may be added to the emulsions. Still further, the dyes may be directly dispersed into hydrophilic colloid, and the resultant dispersion may be added to the emulsions, as is described in JP-A-53-102733 and JP-A-58-105141. The dyes can be added to the emulsions at any stage in the preparation of emulsions which are known to be useful. In other words, the dyes can be added at any time during the preparation of the coating solutions, that is, before the forming of emulsion grains, during the forming of emulsion grains, before the washing of the grains formed, before the chemical sensitization of grains, during the chemical sensitization thereof, or immediately after chemical sensitization before the cooling-solidification of the chemically sensitized emulsions. In most cases, they are added after the chemical sensitization and before the coating of solutions. However, the dyes can be added along with the chemical sensitizer to perform the spectral sensitization simultaneously with the chemical sensitization as is described U.S. Pat. No. 3,628,969 and U.S. Pat. No. 4,225,666. They can be added prior to the chemical sensitization as is described in JP-A-58-113928, or can be added before the precipitation of the silver halide grains to initiate spectral sensitization. Furthermore, as is described in U.S. Pat. No. 4,225,666, the spectral sensitizing dyes may be added in two successive parts, respectively before and after the chemical sensitization. The dyes can be added at any time during the forming of silver halide grains, as in the method disclosed in, for example, U.S. Pat. No. 4,183,756. It is particularly preferable to added the sensitizing dyes before the washing of the emulsions or before the chemical sensitization.

The amount in which to add these spectral sensitizing dyes ranges broadly, preferably $0.5\times10^{-6}$ to $1.0\times10^{-2}$ mol per mol of silver halide, more preferably $1.0\times10^{-6}$ to $5.0\times10^{-3}$ mol per mol of silver halide.

In the case where sensitizing dyes spectrally sensitive from the red region to the infrared region are used in the present invention, they should be used together with the compounds described in JP-A-2-157749, page 13, lower-right column to page 22, lower-right column. The use of these compounds can enhance the storage stability, processing stability, and hyper color-sensitization of the light-sensitive material. It is particularly preferable to use the compounds represented by the formulas (IV), (V), and (VI) described in JP-A-2-157749, along with the spectral sensitizing dyes. These compounds are used in an amount of $0.5\times10^{-5}$ to $5.0\times10^{-2}$ mol per mol of silver halide, preferably $5.0\times10^{-5}$ to $5.0\times10^{-3}$ mol per mol of silver halide. Their effective amount lies within a range of 0.1 to 10000, preferably 0.5 to 5000, in molar ratio to the sensitizing dyes.

The light-sensitive material of the present invention is preferable for processing not only in a print system using an ordinary negative printer, but also in a digital scanning-exposure system which employs monochromic high-intensity light emitted from a gas laser, a light emitting diode, a semiconductor laser, or a second-harmonic generating (SHG) light source, i.e., a combination of a nonlinear optical crystal with a semiconductor laser or a solid-state laser comprising a semiconductor laser used as excitation light source. A semiconductor laser, or a second-harmonic generating (SHG) light source, i.e., a combination of a nonlinear optical crystal with a semiconductor laser or a solid-state laser, should be used to design an apparatus which is compact, inexpensive, durable, and highly reliable. It is desirable that a semiconductor laser be used as at least one of the exposure light sources.

Using the scanning-exposure light source of this type, the maximum spectral sensitivity can be set at any desired value for the light-sensitive material of the present invention, in accordance with the wavelength of the light emitted from the scanning-exposure light source. The SHG light source, made by combining a nonlinear optical crystal with a semiconductor laser or a solid-state laser comprising a semiconductor laser used as excitation light source, can reduce to half the oscillation frequency of the laser and can, therefore, apply blue light and green light. Hence, it is possible to set the maximum spectral sensitivity in the three ordinary light regions, i.e., blue, green and red regions. Preferably, at least two layers of the light-sensitive material should have a maximum spectral sensitivity at wavelengths of 670 nm or more, so that it may be processed in an inexpensive, reliable and compact system comprising a semiconductor layer used as a light source. This is because the III–V group semiconductor available at present has its emission wavelengths in the red and infrared regions only. Laboratory experiments proves that a II–VI group semiconductor laser emits light at wavelengths in the green or blue region. It is well expected that semiconductor lasers capable of reliably emitting light at wave lengths in the green or blue region will be available at low prices when the technology of manufacturing semiconductor lasers advances. Then, it will be less of a requirement that at least two layers of the light-sensitive material have a maximum spectral sensitivity at wavelengths of 670 nm or more.

In the case of such scanning-exposure process, the time for which the silver halide in the light-sensitive material is exposed is the time required for exposing a very small area, which is generally known as a picture element. The amount of light applied to the picture element is controlled by a digital data item. The exposure time therefore depends on the size of the picture element. The size of picture element depends on the picture element density which is, in practice, 50 to 2000 dpi (dots per inch). Assuming that the picture element density is 400 dpi, the exposure time is preferably $10^{-4}$ second or less, more preferably $10^{-6}$ second or less.

Preferably, dyes (particularly, oxonol dye or cyanine dye) disclosed in EP-0,337,490A2, page 27 to 76 and capable of being decolored when processed is added to the hydrophilic colloid layers of the light-sensitive material according to the present invention in order to prevent irradiation or halation and to enhance safelight immunity.

Among these water-soluble dyes are those which may cause color separation or may impair safelight immunity. Preferable dyes which do not impair the safelight immunity when used are the water-soluble dyes described in Japanese Patent Application No. 3-31043, Japanese Patent Application No. 3-310189, and Japanese Patent Application No. 3-310139.

In the present invention, colored layers which can be decolored when processed are used substitutes for water-soluble dyes or together with the water-soluble dyes. These colored layers may directly contact the emulsion layers or may be formed on interlayers containing an agent, such as gelatin or hydroquinone, for preventing color amalgamation. Preferably, the colored layers are arranged beneath (that is, closer to the support than) the emulsion layers which provide primary colors similar to their colors. Colored layers may be provided for all primary colors, or just for some of the primary colors. Alternatively, a single colored layer having parts of different colors corresponding to the primary colors can be used. It is desirable that each colored layer has an optical reflection density of 0.2 to 3.0, preferably 0.5 to 2.5, and more preferably 0.8 to 2.0, when exposed to light of the highest wavelengths (i.e., 400 nm to 700 nm in the case of the ordinary printer exposure, or the wavelengths of the light from a scanning-exposure light source in the case of the scanning-exposure).

The colored layers can be formed by the conventional methods. An example is the method in which the dyes disclosed in, for example, JP-A-2-282244, page 3, upper-right column to page 8, and JP-A-3-7931, page 3, upper-right column to page 11, lower-left column, are dispersed in the form of solid fine grains, into hydrophilic colloid layers. Another example is the method in which an anionic dye is mordanted into cation polymer. Still another example is the method in which a dye is adsorbed into the fine grains of silver halide or the like, thus fixing the dye in the layers. A further example is the method disclosed in JP-A-1-239544, in which colloidal silver is utilized. A method of dispersing dyes into hydrophilic colloid layers, in the form of solid fine grains, is described in JP-A-2-3082244. In this method, a fine-grain dye which is water-insoluble at pH 6 or less, but substantially water-soluble at pH 8 or more is used. A method of mordanting an anionic dye into cation polymer is described in JP-A-2-84637, pages 18 to 26. Methods of preparing colloidal silver for use as light absorbent are disclosed in U.S. Pat. Nos. 2,688,601 and 3,459,563. Of these methods, the preferable ones are the method of dispersing fine dye grains into hydrophilic colloid layers and the method of using colloidal silver.

Gelatin is useful as a binder or protective colloid which can be used in the light-sensitive material according to the present invention. Nonetheless, hydrophilic colloid other than gelatin can be used, either by itself or in combination with gelatin. Preferable for use in the present invention is low-calcium gelatin which contains 800 ppm or less of calcium, preferably 200 ppm or less of calcium. An antifungal agent of the type disclosed in JP-A-63-271247 should be added to the hydrophilic colloid in order to prevent fungi or germs from breeding in the hydrophilic colloid layers.

It is desirable to use the band-stop filter described in U.S. Pat. No. 4,880,726 in subjecting the light-sensitive material of the present invention to printer exposure. The use of this filter prevent color amalgamation, markedly improving color reproduction.

After being exposed to light, the light-sensitive material is color developed in the generally practiced way. For the color light-sensitive material of the present invention it is preferable to perform bleach fixing after color development, for the purpose of increasing the processing speed. Particularly in the case where high-silver chloride emulsions are used, the pH value of the bleach fixing solution is preferably about 6.5 or less, more preferably about 6 or less, in order to accelerate desilverization.

Preferably, the silver halide emulsions and other substances (additives, and the like) used in the light-sensitive material of the present invention, in the photographic layers (or layer arrangement) of the material, in the methods of processing the material, and the additives for use in processing the material are those which are described in EP-0,355,660A2 (i.e., JP-A-2-139544) and which are shown in the following Table 1.

TABLE 1

| Photographic component, etc. | JP-A-62-215272 | JP-A-2-33144 | EP-0,355, 660A2 |
|---|---|---|---|
| Silver halide emulsions | page 10, upper-right column, line 6 to page 12, lower-left column, line 5; page 12, lower-right column, line 4 from bottom to page 13, upper-left column, line 17 | page 28, upper-right column, line 16 to page 29, lower-right column, line 11; page 30, lines 2 to 5 | page 45, line 53 to page 47, line 3; page 47, lines 20 to 22 |
| Solvents for silver halide | page 12, lower-left column, line 6 to 14; page 13, upper-left column, line 3 to page 18, lower-left column, last line | — | — |
| Chemical sensitizers | page 12, lower-left column, line 3 from bottom to lower-right column, line 5 from bottom; page 18, lower-right column, line 1 to page 22, upper-right column, line 9 from bottom | page 29, lower-right column, line 12 to last line | page 47, lines 4 to 9 |
| Spectral sensitizers (Spectral sensitization) | page 22, upper-right column, line 8 from bottom to page 38, last line | page 30, upper-left column, lines 1 to 13 | page 47, lines 10 to 15 |
| Emulsion stabilizers | page 39, upper-left column, line 1 to page 72, upper-right column, last line | page 30, upper-left column, line 14 to upper-right column, line 1 | page 47, lines 16 to 19 |
| Development accelerators | page 72, upper-left column, line 1 to page 91, upper-right column, line 3 | | — |
| Color couplers (cyan, magenta, and yellow couplers) | page 91, upper-right column, line 4 to page 121, upper-left column, line 6 | page 3, upper-right column, line 14 to page 18, upper-left column, last line; page 30, upper right column, line 6 to page 35, lower-right column, line 11 | page 4, lines 15 to 27; page 5, line 30 to page 28, last line; page 45, lines 29 to 31; page 47, line 23 to page 63, line 50 |
| Color intensifies | page 121, upper-left column, line 7 to page 125, upper-right column, line 1 | — | — |
| Ultraviolet absorbents | page 125, upper-right column, line 2 to page 127, lower-left column, last line | page 37, lower-right column, line 14 to page 38, upper-left column, line 11 | page 65, lines 22 tog31 |
| Discolorating inhibitors | page 127, lower-right column, line 1 to page 137, lower-left column, line 8 | page 36, upper-right column, line 12 to page 37, upper-left column, line 19 | page 4, line 20 to page 5, line 23; page 29, line 1 to page 45, line 25; page 45, lines 33 to 40; page 65, lines 2 to 21 |
| High-boiling and/or low-boiling organic solvents | page 137, lower-left column, line 9 to page 144, upper-right column, last line | page 35, lower-right column, line 14 to page 36, upper-left column, line 4 from the bottom | page 64, lines 1 to 51 |
| Method of dispersing photographic additives | page 144, lower-left column, line 1 to page 146, upper-right column, line 7 | page 27, lower-right column, line 10 to page 28, upper-left column, last line; page 35, lower-right column, line 12 to page 36, upper- | page 63, line 51 to page 64, line 56 |

TABLE 1-continued

| Photographic component, etc. | JP-A-62-215272 | JP-A-2-33144 | EP-0,355, 660A2 |
|---|---|---|---|
| | | right column, line 7 | |
| Film hardeners | page 146, upper-right column, line 8 to page 155, lower-left column, line 4 | — | — |
| Precursor of developers | page 155, lower-left column, line 5 to page 155, lower-right column, line 2 | — | — |
| Development inhibitor-compounds | page 155, lower-right column, lines 3 to 9 | — | — |
| Layers of light-sensitive material | page 156, upper-left column, line 15 to page 156, lower-right column, line 14 | page 28, upper-right column, lines 1 to 15 | page 45, lines 41 to 52 |
| Dyes | page 156, lower-right column 15 to page 184, lower-right column, last line | page 38, upper-left column, lines 12 to upper-right column, line 7 | page 66, lines 18 to 22 |
| Color-amalgamon inhibitors | page 185, upper-left column, line 1 to page 188, lower-right column, line 3 | page 36, upper-right column, lines 8 to 11 | page 64, line 57 to page 65 line 1 |
| Gradation adjusting agents | page 188, lower-right column, lines 4 to 8 | — | — |
| Stain inhibitors | page 188, lower-right, line 9 to page 193, lower-right column, line 10 | page 37, upper-left column, last line to lower-right column, line 13 | page 65, line 32 to page 66, line 17 |
| Surfactants | page 201, lower-left column, line 1 to page 210, upper-right column, last line | page 18, upper-right column, line 1 to page 24, lower-right column, last line; page 27, lower-left column, line 10 from bottom to lower-right column, line 9 | — |
| Fluorine-containing compounds (anti-static agents, coating aids, lubricants adhesion preventing agents, etc.) | page 210, lower-left column, line 1 to page 222, lower-left column, line 5 | page 25, upper-left column, line 1 to page 27, lower-right column, line 9 | — |
| Binders (hydrophilic colloids) | page 222, lower-left column, line 6 to page 225, upper-left column, last line | page 38, upper-right column, lines 8 to 18 | page 66, lines 23 to 28 |
| Viscosity increasing agents | page 225, upper-right column, line 1 to page 227, upper-right column, line 2 | — | — |
| Antistatic agents | page 227, upper-right column, line 3 to page 230, upper-left column, line 1 | — | — |
| Polymer latexes | page 230, upper-left column, line 2 to page 239, last line | — | — |
| Matting agents | page 240, upper-left column, line 1 to page 240, upper-right column, last line | — | — |
| Photographic process (process steps, additive, etc.) | page 3, upper-right column, line 7 to page 10, upper-right column, line 5 | page 39, upper-left column, line 4 to page 42, upper-left column, last line | page 67, line 14 to page 69, line 28 |

Note: Items referred from JP-A-62-215272 includes those amended in Amendment filed March 16, 1987, which is specified at the end of the publication. Of the couplers shown in the above tables, preferable yellow couplers are the so-called short-wave yellow couplers disclosed in JP-A-63-231451, JP-A-63-123047, JP-A-63-241547, JP-A-1-173499, JP-A-1-213648, and JP-A-1-250944.

It is desirable that the cyan, magenta and yellow couplers be impregnated in a loadable latex polymer (for example, the one disclosed in U.S. Pat. No. 4,203,716) in (or not in) the presence of the high-boiling organic solvents shown in the above tables, be dissolved together with a water-insoluble, organic solvent-soluble polymer, thereby to be emulsion-dispersed in a hydrophilic colloid aqueous solution. Polymers which can be recited as the preferable water-insoluble, organic solvent-soluble polymer are the monomers or polymers described in U.S. Pat. No. 4,857,449, columns 7 to 15, and PCT International Publication WO 88-00723, pages 12 to 30. More preferable are methacrylate polymers and acrylamide polymers. In particular, the use of acrylamide polymers is desirable sine they help to enhance color-image stability.

In the light-sensitive material according to the present invention, it is desirable to use, together with couplers, the compounds of the type disclosed in EP-0,277,589A2 in order to improve the color-image storage stability of the material. Particularly preferable as such compounds are pyrazoloazole couplers and pyrrolotriazole couplers.

More specifically, an compound disclosed in the patent, which chemically bonds with an aromatic amine-based developing agent remaining after the color development to form a chemically inactive and substantially colorless compound, and/or another compound disclosed in the above patent, which chemically bonds with an oxidized form of an aromatic amine-based developing agent remaining after the color development to form a chemically inactive and substantially colorless compound can be used simultaneously or independently, in order to prevent stain or other side-effects from occurring after processing, which are due to the coloring dye formed by the reaction between the coupler and the residual developing agent or the oxidized form thereof.

Examples of the cyan couplers which are preferably used, in addition to the diphenylimidazole-based cyan coupler disclosed in JP-A-2-23144, are: a 3-hydroxypyridine-based cyan coupler disclosed in EP-0,333,185A2 (preferable are the couplers (6) and (9), and a two-equivalent one prepared by bonding a chlorine leaving group to the four-equivalent coupler exemplified as 42); a cyclic active methylene-based cyan coupler described in JP-A-64-32260 (preferable are the couplers exemplified as 3, 8, and 34); a pyrrolopyrazole-type cyan coupler disclosed in EP-0,456,226A1; a pyrroloimidazole-type cyan coupler disclosed in EP-0,484,909; and a pyrrolotriazole-type cyan coupler described in EP-0,488,248 and EP-0,491,197A1. Of these, the pyrrolotriazole-type cyan coupler is particularly preferred.

Examples of the yellow couplers which are preferably used, in addition to the compounds shown in the above tables, are: an acylacetoamide-type yellow coupler disclosed in EP-0,447,969A1, which has a 3- to 5-membered cyclic structure in the acyl group; a malondianilide-type yellow coupler described in EP-0,482,552A1, which has a cyclic structure; and an acylacetoamide-type yellow coupler described in U.S. Pat. No. 5,118,599, which has a dioxane structure. Of these, particularly preferable are an acylacetoamide-type yellow coupler in which the acyl group is 1-alkylcyclopropane-1-carbonyl group, and a malondianilide-type yellow coupler in which one of the anilides forms an indoline ring. These couplers can be used, either singly or in combination.

The magenta couplers used in the present invention are such 5-pyrazolone-based magenta couplers and the pyrazoloazole-based magenta couplers, all described in the references specified in the above tables. Of these, preferable in terms of hue, image stability and coloring property are: a pyrazolotriazole coupler disclosed in JP-A-61-65245, in which a secondary or tertiary alkyl group directly bonds at the second, third, or sixth position; a pyrazoloazole coupler described in JP-A-61-65246, which has a sulfonamido group; a pyrazoloazole coupler described in JP-A-61-147254, which has an alkoxyphenylsulfonamido ballast group; and a pyrazoloazole coupler disclosed in EP-226,849A and EP-294,785A, which has an alkoxy group or an aryloxy group at the sixth position.

Preferable processing materials and methods, other than those specified in the above tables, which can be employed to process the color light-sensitive material of the present invention are described in JP-A-2-207250, page 26, lower-right column, line 1 to page 34, upper-right column, line 9 and JP-A-4-97355, page 5, upper-left column, line 17 to page 18, lower-right column, line 20.

EXAMPLE

Examples of the present invention will be described in the following. Nonetheless, the modes of the present invention are not limited to these examples.

Example 1

(Preparation of the raw Paper)

A wood pulp mixture (LBKP/NBSP=2/1) was beat into pieces, thereby obtaining pulp slurry of Canadian freeness of 250 cc. The pulp slurry was diluted with water. While stirring the diluted slurry, anionic polyacrylamide (Polystron 195 having a molecular weight of about 1,100,000, and manufactured by Arakawa Kagaku Co., Ltd.), aluminum sulfate, and polyamidopolyamine epichlohydrin (Caimen 557 manufactured by Dick Hercules, Inc.) were added to the slurry in amounts of 1.0%, 1.0%, and 0.15% by weight (based on the pulp), respectively. Further, epoxlylated behenic acid amide and alkylketenedimer (a compound having alkyl group $C_{20}H_{41}$) were added, each in an amount of 0.4% by weight (based on the pulp), to the slurry. Sodium hydroxide was added, thereby adjusting the pH value to 7. Then, cationic polyacrylamide and defoaming agent were added in amounts of 0.5% and 0.1% by weight (based on the pulp), respectively. Using the slurry, thus prepared, a raw paper was made which had a weighting capacity of 180 g/m$^2$.

Next, the raw paper was dried in an oven, adjusting its water content to about 2%. A surface sizing agent (an aqueous solution) having the composition specified below was size-pressed onto the raw paper, whereby the solution was coated in an amount of 20 g/m$^2$ on that surface of the raw paper on which photographic emulsions were to be coated.

| Composition of the surface sizing agent | |
|---|---|
| Polyvinyl alcohol: | 4.0% |
| Calcium chloride: | 4.0% |
| Fluorescent whitening agent: | 0.5% |
| Defoaming agent: | 0.005% |

Then, the raw paper substrate coated with the sizing agent was surface-treated by means of a machine calender, to have its thickness adjusted to 180 μm.

(Preparation of the Support)

Polyesters (maximum viscosity: 6.5), shown in the following Table 2, obtained by polycondensation of dicarboxylic acid and ethylene glycol, and polyethylenes were mixed with titanium oxide (KA-10 manufactured by Titan Kogyo Co., Ltd.), thereby forming various mixtures. The mixtures thus prepared was melted at 300° C., and mixed and extruded through a T die by a two-roll mixer-extruder onto the surface of the raw paper, thereby laminating a layer having a thickness of 30 μm on the above-mentioned surface of the raw paper having a thickness of 180 μm. Also, a polyethyleneterephthalate composition (molecular weight: about 40,000) containing calcium carbonate was melt and extruded at 300° C. onto the other surface of the raw paper, thereby laminating thereon a layer having a thickness of 30 μm. The raw paper was laminated on both surfaces. That surface of the laminated paper support on which to coat emulsions was processed with corona discharge treatment, and was coated, in an amount of 5 cc/m$^2$, with a solution having the following composition. The paper support was dried at 80° C. for 2 minutes. As a result, seven types of photographic supports A to J were prepared.

| Composition of the undercoating | |
|---|---|
| Compound (ExU1) indicated below: | 0.2 g |
| Compound (ExU2) indicated below: | 0.001 g |
| $H_2O$: | 35 cc |
| Methanol: | 65 cc |
| Gelatin: | 2.0 g |
| pH: | 9.5 |

TABLE 2

| Support | Thermoplastic resin (dicarboxylic acids composition of polyester ratio by weight) | $TiO_2$ content (wt %) |
|---|---|---|
| A | Polyethylene | 10 |
| B | Polyethylene | 20 |
| C | Polyethylene | 30 |
| D | Polyester (terephthalic acid 100) | 10 |
| E | Polyester (terephthalic acid 100) | 20 |
| F | Polyester (terephthalic acid 100) | 30 |
| G | Polyester (terephthalic acid/isophthalic acid 90/10) | 20 |
| H | Polyester (terephthalic acid/isophthalic acid 50/50) | 20 |
| I | Polyester (terephthalic acid/naphthalene dicarboxylic acid 90/10) | 20 |
| J | Polyester (terephthalic acid/naphthalene dicarboxyhlic acid 50/50) | 20 |

Compound (ExU1)

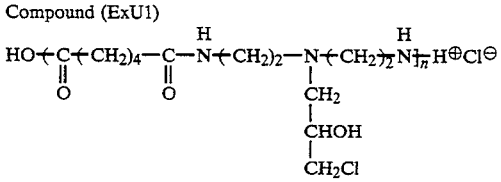

Compound (ExU2)
$C_{12}H_{25}O(CH_2CH_2O)_{10}H$ (Preparation of the Light-Sensitive Material)

Various photographic layers were coated on the reflective support A, thereby preparing a color photographic printing paper (I) having the following multilayered structure. The coating solutions were prepared as follows:

Preparation of the first-layer coating solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 25 g of a solvent (Solv-1), 25 g of another solvent (Solv-2), and 180 cc of ethyl acetate, thereby forming a solution. This solution was emulsified and dispersed into 1000 cc of a 10% gelatin aqueous solution containing 60 cc of 10% sodium dodecylbenzensulfonate and 10 g of citric acid, thus forming an emulsified dispersion A. Meanwhile, silver chlorobromide emulsion A-1 was prepared. This emulsion was a mixture of an emulsion containing large size cubic grains having an average size of 0.88 μm and an emulsion containing small size cubic grains having an average size of 0.70 μm, mixed together in a mixing ratio of 3:7 (silver mol ratio). These emulsions had variation coefficients of 0.08 and 0.10, respectively, in terms of the grain-size distribution. Both emulsion contained silver halide grains, each consisting of 0.3 mol % of silver bromide locally existing in the surface region and the remainder being silver chloride. Each grain contained potassium iridium (IV) hexachlorate and potassium ferrocyanate in both the inner part and the surface, each in a total amount of 1.0 mg. Blue-sensitive sensitizing dyes A and B, which will be specified in the following Table 7, were each added to the first emulsion in an amount of $2.0\times10^{-4}$ mol per mol of silver and to the second emulsion in an amount of $2.5\times10^{-4}$ mol per mol of silver. Thereafter, $1\times10^{-5}$ mol/mol Ag of a sulfur sensitizer (triethylthiourea) and $1\times10^{-5}$ mol/mol Ag of a gold sensitizer (chloroauric acid) were added to the silver chlorobromide emulsion A-1 at pH of 6.7 and pAg of 7.0 in the presence of a decomposed product of nucleic acid (0.2 g/molAg), thus performing optimal chemical sensitization on the emulsion A-1. The emulsified dispersion A and the silver chlorobromide emulsion A-1 were mixed and dissolved, thereby preparing the first layer coating solution which had the composition to be specified later.

The second- to seventh-layer coating solutions were prepared in the same way as the first-layer coating solution. In each of the seven-layer coating solutions, 1-oxy-3,5-dichloro-s-triazine sodium salt was used as the gelatin-hardening agent.

Also, Cpd-14 and Cpd-15 were added to each layer, in total amounts of 25.0 mg/m² and 50.0 mg/m², respectively.

The silver chlorobromide emulsion in each light-sensitive emulsion layer was prepared in the same way as the silver chlorobromide emulsion A-1, except that the grain size and halogen composition were changed and that a spectral sensitizing dye specified below was used.

TABLE 3

Blue-sensitive emulsion layer

Sensitizing dye A

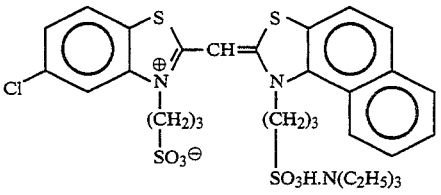

and

Sensitizing dye B

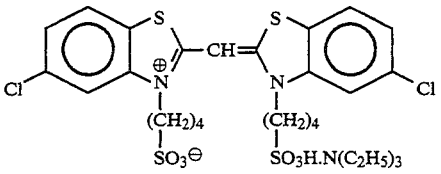

(Dyes A and B were added to the emulsion containing large size grains in an amount of $2.0\times10^{-4}$ mol per mol of silver halide and to the emulsion containing small size grains in an amount of $2.5\times10^{-4}$ mol per mol of silver halide).

TABLE 4

Green-sensitive emulsion layer

Sensitizing dye C

TABLE 4-continued

Green-sensitive emulsion layer

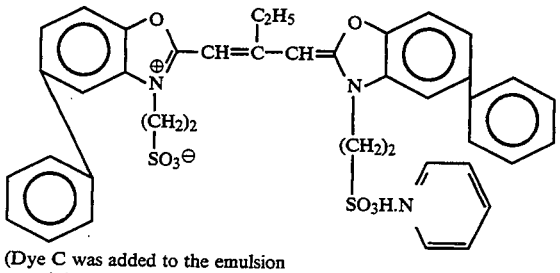

(Dye C was added to the emulsion containing large size grains in an amount of $4.0 \times 10^{-4}$ mol per mol of silver halide and to the emulsion containing small size grains in an amount of $5.6 \times 10^{-4}$ mol per mol of silver halide.)

and

Sensitizing dye D

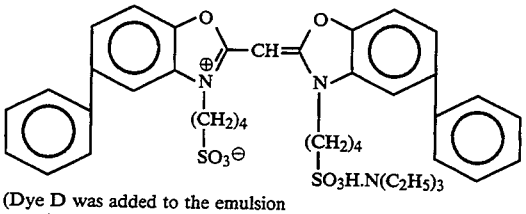

(Dye D was added to the emulsion containing large size grains in an amount of $7.0 \times 10^{-5}$ mol per mol of silver halide and to size the emulsion containing small size graina in an amount of $1.0 \times 10^{-4}$ mole per mol of silver halide.)

TABLE 5

Red-sensitive emulsion layer

Sensitizing dye E

TABLE 5-continued

Red-sensitive emulsion layer

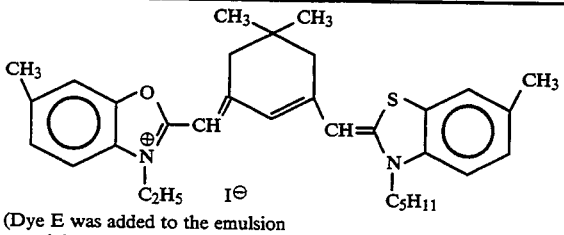

(Dye E was added to the emulsion containing large size grains in an amount of $0.9 \times 10^{-4}$ mol per mol of silver halide and to the emulsion containing small size grains size in an amount of $1.1 \times 10^{-4}$ mol per mol of silver halide.) Furthur, the below-identified compound was added in an amount of $2.6 \times 10^{-3}$ mol per mol of silver halide.

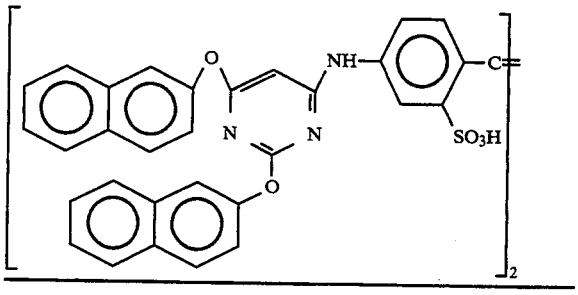

Moreover, 1-(5-methylureidophenyl)-5-mercaptotetrazole was added to the blue-sensitive emulsion layer, the green-sensitive emulsion layer, and the red-sensitive emulsion layer in amounts of $2.5 \times 10^{-3}$ mol, $4.0 \times 10^{-3}$ mol, and $1.5 \times 10^{-4}$ mol per mol of silver halide, respectively. Further, 4-hydroxy-6-methyl-1,3,3a,7-tetraazinedine was added to the blue-sensitive emulsion layer in an amount of $1 \times 10^{-4}$ mol per mol of silver halide, and to the green-sensitive emulsion layer in an amount of $2 \times 10^{-4}$ mol per mol of silver halide.

In order to prevent irradiation, the dyes identified below were added to each emulsion layer in the coated amounts specified in the parentheses. (These dyes are water-soluble, and did dispersed in the all photographic emulsion layers.)

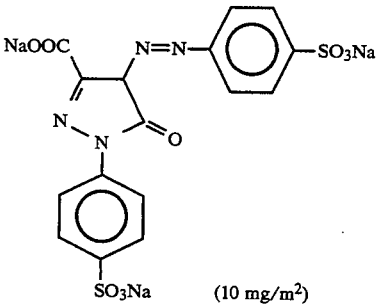

(10 mg/m²)

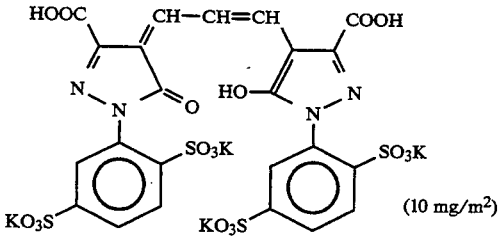

(10 mg/m²)

-continued

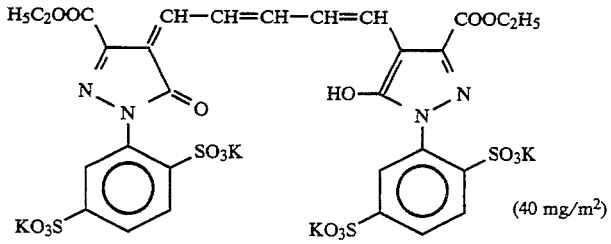

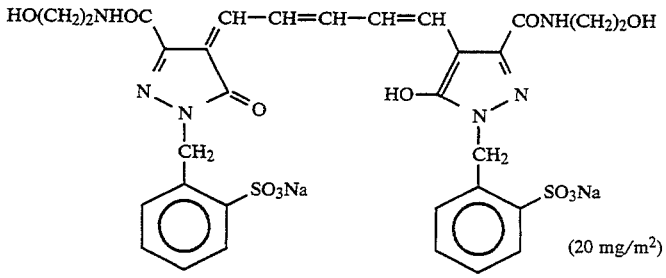

(Compositions of the Layers)

The composition of each layer will be described. The numerals specified along with each component indicates the coating amount (g/m$^2$) of the component. The coating amount of a silver halide is represented in terms of the amount of silver coated.

Support Polyethylene-laminated paper, including a polyethylene layer containing a white pigment ($TiO_2$; content: 14% by weight) and a blue dye (ultramarine) and formed on that surface on which light-sensitive layers are formed

| | |
|---|---|
| Layer 1: Blue-sensitive emulsion layer | |
| Silver chlorobromide emulsion A-1 silver above | 0.27 |
| Gelatin | 1.26 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Layer 2: Color-amalgamation inhibiting layer | |
| Gelatin | 0.80 |
| Color-amalgamation inhibitor (Cpd-4) | 0.06 |
| Solvent (Solv-7) | 0.03 |
| Solvent (Solv-2) | 0.25 |
| Solvent (Solv-3) | 0.25 |
| Layer 3: Green-sensitive emulsion layer | |
| Silver chlorobromide emulsion B-1 (A mixture of an emulsion containing large size grains having an average size of 0.55 μm and an emulsion containing small size grains having an average size of 0.39 μm, mixed together in mixing ratio of 1:3 (silver mol ratio). These emulsions had variation coefficients of 0.10 and 0.08, respectively, in terms of the grain-size distribution. Either emulsion contained silver halide grains, each consisting of 0.8 mol % of silver bromide locally existing in the surface region and the remainder being silver chloride. Each grain contained potassium iridium (IV) hexachlorate and potassium ferrocyanate in both the inner part and the surface, in amounts of 0.2 mg and 1 mg, respectively. The emulsion B-1 was subjected to optimal chemical sensitization by adding the same sulfur sensitizer and the same gold sensitizer as used in the layer 1, in the presence of a decomposed product of nucleic acid.) | 0.13 |

-continued

| | |
|---|---|
| Gelatin | 1.40 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Layer 4: Color-amalgamation inhibiting layer | |
| Gelatin | 0.65 |
| Color-amalgamation inhibitor (Cpd-4) | 0.04 |
| Solvent (Solv-7) | 0.02 |
| Solvent (Solv-2) | 0.18 |
| Solvent (Solv-3) | 0.18 |
| Layer 5: Red-sensitive emulsion layer | |
| Silver chlorobromide emulsion C-1 (A mixture of an emulsion containing large size grains having an average size of 0.50 μm and an emulsion containing small size grains having an average size of 0.41 μm, mixed together in mixing ratio of 1:4 (silver mol ratio). These emulsions had variation coefficients of 0.09 and 0.11, respectively, in terms of the grain-size distribution. Either emulsion contained silver halide grains, each consisting of 0.8 mol % of silver bromide locally existing in the surface region and the remainder being silver chloride. Each grain contained potassium iridium (IV) hexachlorate and potassium ferrocyanate in both the inner part and the surface, in amounts of 0.2 mg and 1.2 mg, respectively. The emulsion C-1 was subjected to optimal chemical sensitization by adding the same sulfur sensitizer and the same gold sensitizer as used in the layer 1, in the presence of a decomposed product of nucleic acid.) | 0.20 |
| Gelatin | 0.80 |
| Cyan coupler (ExC) | 0.33 |
| Ultraviolet absorbent (UV-2) | 0.18 |
| Dye image stabilizer (Cpd-1) | 0.33 |
| Dye image stabilizer (Cpd-6) | 0.01 |
| Dye image stabilizer (Cpd-8) | 0.01 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-1) | 0.01 |
| Solvent (Solv-6) | 0.22 |
| Layer 6: Ultraviolet absorbing layer | |
| Gelatin | 0.50 |
| Ultraviolet absorbent (UV-1) | 0.38 |
| Dye image stabilizer (Cpd-5) | 0.02 |

-continued

| | |
|---|---|
| Dye image stabilizer (Cpd-12) | 0.15 |
| Layer 7: Protective layer | |
| Gelatin | 1.00 |
| Acrylic modified copolymer of polyvinyl alcohols (modification degree: 17%) | 0.05 |
| Liquid paraffin | 0.02 |
| Dye image stabilizer (Cpd-13) | 0.01 |

The compounds used in the above-mentioned layers will be specified blow:

Yellow coupler (ExY)

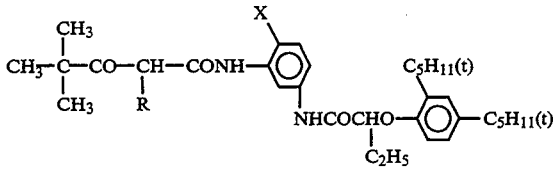

This is a 1:1 mixture (molar ratio of the following compounds (1) and (2):

(1)

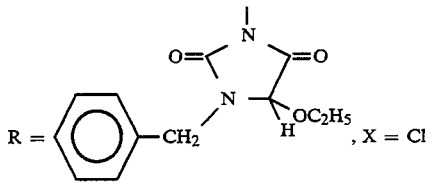

(2)

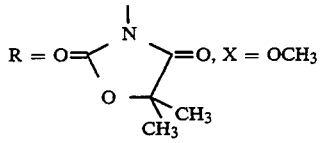

Magenta coupler (ExM)

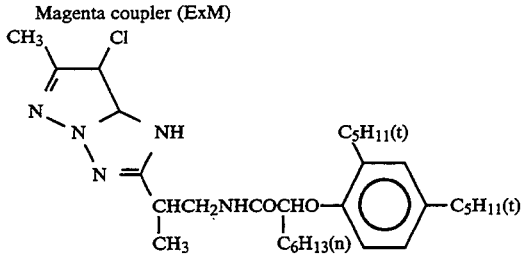

Cyan coupler (ExC)

This is a 3:7 mixture (molar ratio) of the following ctwo compounds:

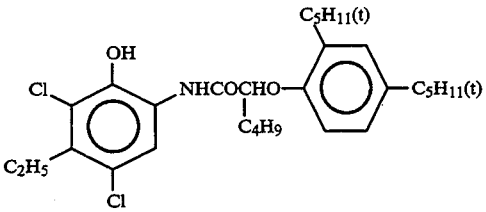

and

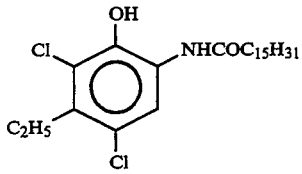

Dye image stabilizer (Cpd-1)

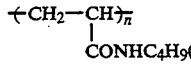

Average molecular weight: 60,000

Dye image stabilizer (Cpd-2)

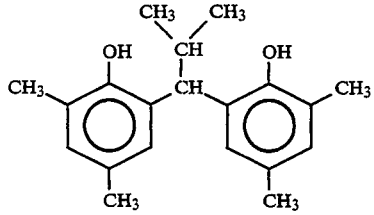

Dye image stabilizer (Cpd-3)

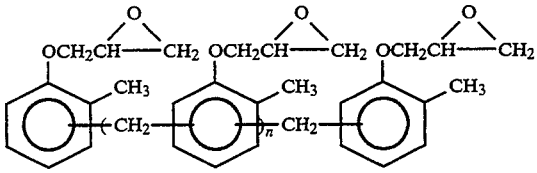

n =7 to 8 (ave. value)

Color-amalgamation inhibitor (Cpd-4)

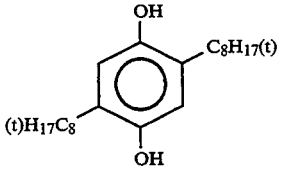

Dye image stabilizer (Cpd-5)

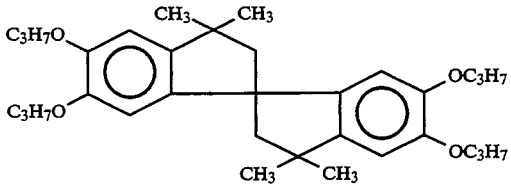

Dye image stabilizer (Cpd-6)

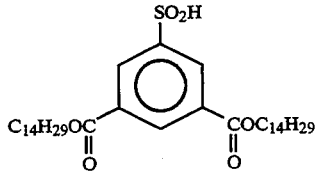

Dye image stabilizer (Cpd-7)

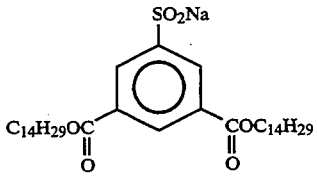

Dye image stabilizer (Cpd-8)

-continued

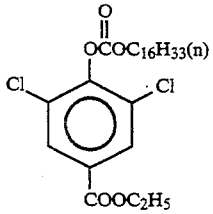

Dye image stabilizer (Cpd-9)

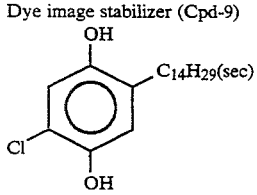

Dye image stabilizer (Cpd-10)

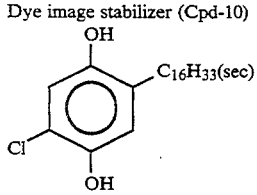

Dye image stabilizer (Cpd-11)

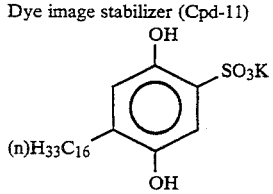

Dye image stabilizer (Cpd-12)

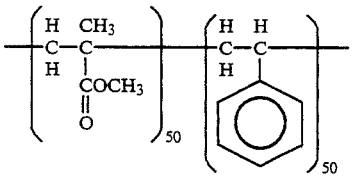

Average molecular weight: about 60,000

Dye image stabilizer (Cpd-13)

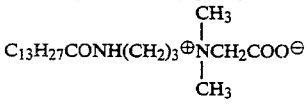

Antiseptic agent (Cpd-14)

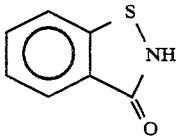

Antiseptic agent (Cpd-15)

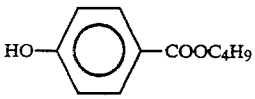

Ultraviolet absorbent (UV-1)

A mixture of the following compounds (i), (ii), (iii) and (iv) mixed together in weight ratio of 1:5:10:5

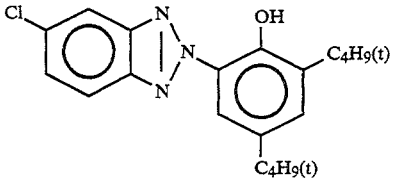

(i)

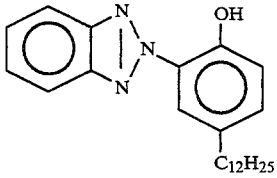

(ii)

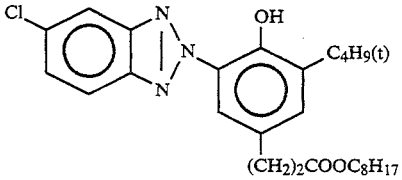

(iii)

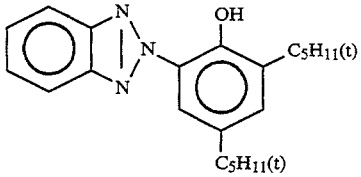

(iv)

Ultraviolet absorbent (UV-2 )

A mixture of the following compounds (i), (ii) and (iii) mixed together in weight ratio of 1:2:2

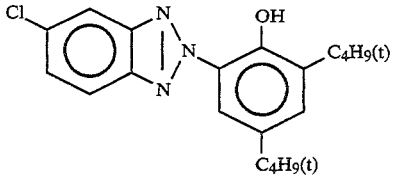

(i)

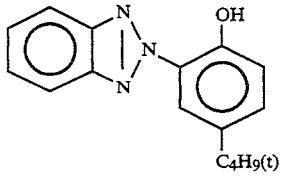

(ii)

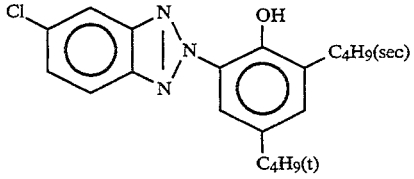

(iii)

Solvent (Solv-1)

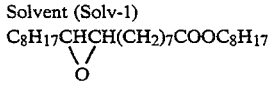

Solvent (Solv-2)

-continued

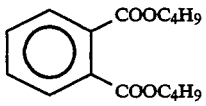

Solvent (Solv-3)

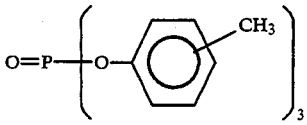

Solvent (Solv-4)

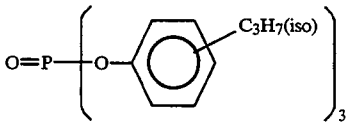

Solvent (Solv-5)

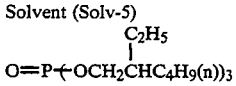

Solvent (Solv-6)

-continued

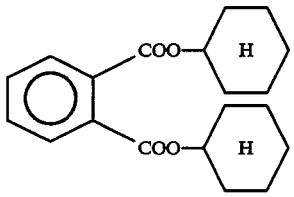

Solvent (Solv-7)

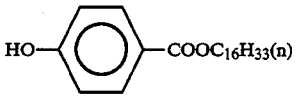

Multi-layered color photographic printing paper (I), which is specified in Table 6, was thereby prepared. Furthermore, two types (II) and (III) of multi-layered color photographic printing paper, also specified in Table 6, were prepared, each being identical to the printing paper (I) except for the total amount of gelatin coated and the total amount of silver halide coated.

Using the three types (I), (II) and (III) of printing paper, there were prepared samples 101 to 154 specified in Table 8, each differing from any other in silver halide emulsions used (shown in Table 7) and support employed.

TABLE 6

| | I | | II | | III | |
|---|---|---|---|---|---|---|
| | Amount of silver coated | Amount of gelatin coated | Amount of silver coated | Amount of gelatin coated | Amount of silver coated | Amount of gelatin coated |
| Layer 1 | 0.27 | 1.26 | 0.30 | 0.75 | 0.19 | 2.27 |
| Layer 2 | — | 0.80 | — | 0.40 | — | 1.85 |
| Layer 3 | 0.13 | 1.40 | 0.25 | 0.84 | 0.11 | 2.50 |
| Layer 4 | — | 0.65 | — | 0.33 | — | 1.50 |
| Layer 5 | 0.20 | 0.80 | 0.30 | 0.48 | 0.14 | 1.85 |
| Layer 6 | — | 0.50 | — | 0.25 | — | 1.15 |
| Layer 7 | — | 1.00 | — | 0.50 | — | 2.30 |
| total ($g/m^2$) | 0.60 | 6.41 | 0.85 | 3.55 | 0.44 | 13.42 |

TABLE 7

| | Emulsion | Halogen composition | Grain size blending ratio | Spectral sensitizing dye used |
|---|---|---|---|---|
| Blue-sensitive emulsion | A-1 | AgBrCl (Br = 0.3%) | 0.88 μm/0.70 μm | Sensitizing dye A/B |
| | A-2 | AgBrCl (Br = 20%) | 0.86 μm/0.71 μm | Sensitizing dye A/B |
| | A-3 | AgBrCl (Br = 60%) | 0.87 μm/0.69 μm | Sensitizing dye A/B |
| Green-sensitive emulsion | B-1 | AgBrCl (Br = 0.3%) | 0.49 μm/0.37 μm | Sensitizing dye C/D |
| | B-2 | AgBrCl (Br = 20%) | 0.49 μm/0.38 μm | Sensitizing dye C/D |
| | B-3 | AgBrCl (Br = 60%) | 0.50 μm/0.38 μm | Sensitizing dye C/D |
| Red-sensitive emulsion | C-1 | AgBrCl (Br = 0.3%) | 0.54 μm/0.45 μm | Sensitizing dye E |
| | C-2 | AgBrCl (Br = 20%) | 0.55 μm/0.43 μm | Sensitizing dye E |
| | C-3 | AgBrCl (Br = 60%) | 0.55 μm/0.44 μm | Sensitizing dye E |

TABLE 8

| Sample No. | Support | Basic light-sensitive material | Blue-sensitive emulsion | Green-sensitive emulsion | Red-sensitive emulsion | All gelatin coated ($g/m^2$) | All silver coated ($g/m^2$) | Ratio | Remarks |
|---|---|---|---|---|---|---|---|---|---|
| 101 | A | II | A-1 | B-1 | C-1 | 3.55 | 0.85 | 4.18 | Comparative example |
| 102 | " | " | A-2 | B-2 | C-2 | " | " | " | " |
| 103 | " | " | A-3 | B-3 | C-3 | " | " | " | " |
| 104 | B | " | A-1 | B-1 | C-1 | " | " | " | " |
| 105 | " | " | A-2 | B-2 | C-2 | " | " | " | " |
| 106 | " | " | A-3 | B-3 | C-3 | " | " | " | " |
| 107 | C | " | A-1 | B-1 | C-1 | " | " | " | " |
| 108 | " | " | A-2 | B-2 | C-2 | " | " | " | " |
| 109 | " | " | A-3 | B-3 | C-3 | " | " | " | " |
| 110 | D | " | A-1 | B-1 | C-1 | " | " | " | " |

TABLE 8-continued

| Sample No. | Support | Basic light-sensitive material | Blue-sensitive emulsion | Green-sensitive emulsion | Red-sensitive emulsion | All gelatin coated ($g/m^2$) | All silver coated ($g/m^2$) | Ratio | Remarks |
|---|---|---|---|---|---|---|---|---|---|
| 111 | " | " | A-2 | B-2 | C-2 | " | " | " | " |
| 112 | " | " | A-3 | B-3 | C-3 | " | " | " | " |
| 113 | E | " | A-1 | B-1 | C-1 | " | " | " | " |
| 114 | E | II | A-2 | B-2 | C-2 | 3.55 | 0.85 | 4.18 | Comparative Example |
| 115 | " | " | A-3 | B-3 | C-3 | " | " | " | " |
| 116 | F | " | A-1 | B-1 | C-1 | " | " | " | " |
| 117 | " | " | A-2 | B-2 | C-2 | " | " | " | " |
| 118 | " | " | A-3 | B-3 | C-3 | " | " | " | " |
| 119 | A | I | A-1 | B-1 | C-1 | 6.41 | 0.60 | 10.68 | " |
| 120 | " | " | A-2 | B-2 | C-2 | " | " | " | " |
| 121 | " | " | A-3 | B-3 | C-3 | " | " | " | " |
| 122 | B | " | A-1 | B-1 | C-1 | " | " | " | " |
| 123 | " | " | A-2 | B-2 | C-2 | " | " | " | " |
| 124 | " | " | A-3 | B-3 | C-3 | " | " | " | " |
| 125 | C | " | A-1 | B-1 | C-1 | " | " | " | " |
| 126 | " | " | A-2 | B-2 | C-2 | " | " | " | " |
| 127 | " | " | A-3 | B-3 | C-3 | " | " | " | " |
| 128 | D | I | A-1 | B-1 | C-1 | 6.41 | 0.60 | 10.68 | Present invention |
| 129 | " | " | A-2 | B-2 | C-2 | " | " | " | Comparative example |
| 130 | " | " | A-3 | B-3 | C-3 | " | " | " | " |
| 131 | E | " | A-1 | B-1 | C-1 | " | " | " | Present invention |
| 132 | " | " | A-2 | B-2 | C-2 | " | " | " | Comparative example |
| 133 | " | " | A-3 | B-3 | C-3 | " | " | " | " |
| 134 | F | " | A-1 | B-1 | C-1 | " | " | " | Present invention |
| 135 | " | " | A-2 | B-2 | C-2 | " | " | " | Comparative example |
| 136 | " | " | A-3 | B-3 | C-3 | " | " | " | " |
| 137 | A | III | A-1 | B-1 | C-1 | 13.42 | 0.44 | 30.50 | " |
| 138 | " | " | A-2 | B-2 | C-2 | " | " | " | " |
| 139 | A | III | A-3 | B-3 | C-3 | 13.42 | 0.44 | 30.50 | Comparative Example |
| 140 | B | " | A-1 | B-1 | C-1 | " | " | " | " |
| 141 | " | " | A-2 | B-2 | C-2 | " | " | " | " |
| 142 | " | " | A-3 | B-3 | C-3 | " | " | " | " |
| 143 | C | " | A-1 | B-1 | C-1 | " | " | " | " |
| 144 | " | " | A-2 | B-2 | C-2 | " | " | " | " |
| 145 | " | " | A-3 | B-3 | C-3 | " | " | " | " |
| 146 | D | " | A-1 | B-1 | C-1 | " | " | " | " |
| 147 | " | " | A-2 | B-2 | C-2 | " | " | " | " |
| 148 | " | " | A-3 | B-3 | C-3 | " | " | " | " |
| 149 | E | " | A-1 | B-1 | C-1 | " | " | " | " |
| 150 | E | III | A-2 | B-2 | C-2 | 13.42 | 0.44 | 30.50 | Comparative example |
| 151 | " | " | A-3 | B-3 | C-3 | " | " | " | " |
| 152 | F | " | A-1 | B-1 | C-1 | " | " | " | " |
| 153 | " | " | A-2 | B-2 | C-2 | " | " | " | " |
| 154 | " | " | A-3 | B-3 | C-3 | " | " | " | " |

Sensitometry light of 250 CMS was applied for 1 second to the samples of, light-sensitive materials, thus prepared, through an optical wedge and a color filter from a sensitometer (Model FWH with a light-source color temperature of 3200 K., manufactured by Fuji Photo Film Co., Ltd.). Thereafter, the samples were color-developed by the processing which will be described later, using the solutions the compositions of which will be specified later. To evaluate the speed at which each sample could be processed, the periods of time were measured which the sample required to attain a maximum yellow density, a maximum magenta density, and a maximum cyan density.

Next, in order to determine the sharpness of each sample, the sample was exposed to light applied through a rectangular pattern placed on the sample in direct contact. The pattern had been deposited on a glass substrate and had a density difference of 0.5 attained by changing spatial frequency. The light was applied through a green filter so that the sample may bear magenta color to which human eye are more sensitive than any other color. The developing time was 45 seconds. The density of the resultant rectangular image was measured by means of a micro-densitometer with high precision, thereby finding the spatial frequency which would set the CTF value at 0.5. The spatial frequency, thus obtained, was used as a yardstick for the sharpness of the sample.

Further, to determine whether or not the cut edges of a processed color print, unexposed 20 pieces of each sample were processed and then cut to a L print size. Then, these processed pieces were examined to visually determine whether the edges of each had been colored. The criteria used for this edge-coloring test were as follows:

⦶: Not colored at all in 20 pieces
○: One or two pieces colored in 20 pieces
Δ: Three to six pieces colored in 20 pieces
X: Seven or more pieces colored in 20 pieces
XX: Seven or more pieces much colored in 20 pieces In addition, in order to evaluate the surface gloss of prints, the samples were uniformly exposed to such that each attained a maximum yellow density, a maximum magenta density, and a maximum cyan density. These samples were visually examined for their surface glosses. The criteria used for this surface-gloss test were as follows:

⦶: Excellent
○: Good
X: Poor

The results of the edge-coloring test and those of the surface-gloss test were as is shown in Table 9 which will be presented later.

| Step | Temp. | Processing Method Time | Quantity* of replesnisher | Tank volume |
|---|---|---|---|---|
| Color development | 35 | 45 sec. | 161 ml | 17 liters |
| Bleach-fixing | 30–35 | 45 sec. | 215 ml | 17 liters |
| Rinsing 1** | 30–35 | 20 sec. | — | 10 liters |
| Rinsing 2** | 30–35 | 20 sec. | — | 10 liters |
| Rinsing 3** | 30–35 | 20 sec. | 350 ml | 10 liters |
| Drying | 70–80 | 60 sec. | | |

*The quantity of replenisher is a quantity per meter of the light-sensitive material.
**The rinsing was performed in counter flow, from step 3 to step 2, and hence to step 1.

The compositions of the solutions used in the color-processing are as follows:

| | Tank solution | Re-plenisher |
|---|---|---|
| Color Developing Solution: | | |
| Water | 800 ml | 800 ml |
| Ethylenediamine-N,N,N',N-tetrametyylen sulfonic acid | 1.5 g | 2.0 g |
| Potassium bromide | 0.015 g | — |
| Triethanol amine | 8.0 g | 12.0 g |
| Sodium chloride | 1.4 g | — |

-continued

| | Tank solution | Re-plenisher |
|---|---|---|
| Potassium carbide | 25 g | 25.0 g |
| N-ethyl-N-β-methanesulfonamido-ethyl)-3-methyl-4-aminoaniline sulfate | 5.0 g | 7.0 g |
| N,N-bis(carboxymethyl) hydrazine | 4.0 g | 5.0 g |
| N,N-di(sulfoethyl) hydroxylamine.1Na | 4.0 g | 5.0 g |
| Fluorescent whiteing agent (WHITEX 4B, Sumitomo Kagaku) | 1.0 g | 2.0 g |
| Water to make | 1000 ml | 1000 ml |
| pH (25° C.) | 10.05 | 10.45 |
| Bleach-fixing solution: Common to Tank solution and Replenisher | | |
| Water | 400 ml | |
| Ammonium thiosulfate (700 g/liter) | 100 ml | |
| Sodium sulfite | 17 g | |
| Ammonium Fe (III) ethylenediamine tetraacetate | 55 g | |
| Disodium ethylenediamine tetraacetate | 5 g | |
| Ammonium bromide | 40 g | |
| Water to make | 1000 ml | |
| pH(25° C.) | 6.0 | |
| Rinsing solution | | |
| Ion-exchange water (calcium and magnesium, each in an amount of 3 ppm or less) | | |

TABLE 9

| Sample No. | Time for acquiring max color density | Sharpness (CTF value) | Coloring at cut edges | Surface gloss after process | Remarks |
|---|---|---|---|---|---|
| 101 | 27 sec | 10.8 | ◐ | ○ | Comparative example |
| 102 | 68 sec | 10.9 | ◐ | ○ | " |
| 103 | 102 sec | 11.1 | ◐ | ○ | " |
| 104 | 26 sec | 16.9 | ○ | Δ | " |
| 105 | 69 sec | 16.8 | ○ | Δ | " |
| 106 | 104 sec | 16.7 | ○ | Δ | " |
| 107 | 28 sec | 19.1 | Δ | X | " |
| 108 | 68 sec | 19.2 | Δ | X | " |
| 109 | 103 sec | 19.0 | Δ | X | " |
| 110 | 27 sec | 12.7 | X | ○ | " |
| 111 | 66 sec | 12.5 | X | ○ | " |
| 112 | 105 sec | 12.5 | X | ○ | " |
| 113 | 29 sec | 17.9 | X | ○ | " |
| 114 | 67 sec | 17.5 | X | ○ | " |
| 115 | 103 sec | 17.6 | X | ○ | " |
| 116 | 29 sec | 20.3 | XX | ○ | Comparative example |
| 117 | 68 sec | 20.2 | XX | ○ | " |
| 118 | 104 sec | 20.4 | XX | ○ | " |
| 119 | 29 sec | 10.3 | ◐ | ◐ | " |
| 120 | 71 sec | 11.0 | ◐ | ◐ | " |
| 121 | 110 sec | 10.9 | ◐ | ◐ | " |
| 122 | 31 sec | 16.5 | ○ | ○ | " |
| 123 | 73 sec | 16.2 | ◐ | ○ | " |
| 124 | 111 sec | 16.0 | ◐ | ○ | " |
| 125 | 30 sec | 18.9 | Δ | X | " |
| 126 | 72 sec | 19.0 | ○ | X | " |
| 127 | 109 sec | 19.1 | ○ | X | " |
| 128 | 31 sec | 12.2 | ◐ | ◐ | Present invention |
| 129 | 74 sec | 11.9 | ◐ | ◐ | Comparative example |
| 130 | 113 sec | 12.1 | ◐ | ◐ | " |
| 131 | 31 sec | 17.3 | ◐ | ◐ | Present invention |
| 132 | 73 sec | 17.6 | ◐ | ◐ | Comparative example |
| 133 | 112 sec | 17.7 | ◐ | ◐ | " |
| 134 | 30 sec | 20.1 | ○ | ◐ | Present invention |
| 135 | 72 sec | 19.7 | ○ | ◐ | Comparative example |
| 136 | 110 sec | 19.8 | ○ | ◐ | " |
| 137 | 48 sec | 10.1 | ◐ | ◐ | " |
| 138 | 84 sec | 10.4 | ◐ | ◐ | " |
| 139 | 127 sec | 10.3 | ◐ | ◐ | " |
| 140 | 51 sec | 15.8 | ◐ | ○ | " |
| 141 | 85 sec | 15.9 | ◐ | ○ | " |
| 142 | 128 sec | 15.7 | ◐ | ○ | " |

TABLE 9-continued

| Sample No. | Time for acquiring max color density | Sharpness (CTF value) | Coloring at cut edges | Surface gloss after process | Remarks |
|---|---|---|---|---|---|
| 143 | 49 sec | 18.1 | ⦶ | X | " |
| 144 | 86 sec | 18.3 | ⦶ | X | " |
| 145 | 129 sec | 18.4 | ⦶ | X | " |
| 146 | 50 sec | 12.0 | ⦶ | ⦶ | Comparative example |
| 147 | 85 sec | 11.9 | ⦶ | ⦶ | " |
| 148 | 131 sec | 11.8 | ⦶ | ⦶ | " |
| 149 | 47 sec | 16.3 | ⦶ | ⦶ | " |
| 150 | 86 sec | 16.2 | ⦶ | ⦶ | " |
| 151 | 130 sec | 16.5 | ⦶ | ⦶ | " |
| 152 | 49 sec | 19.1 | ○ | ⦶ | " |
| 153 | 87 sec | 19.2 | ⦶ | ⦶ | " |
| 154 | 131 sec | 19.0 | ⦶ | ⦶ | " |

As is evident from Table 9, in the case that the composition of silver halide emulsions is changed the samples according to the present invention, prepared by using the emulsions (A-1, B-1, and C-1) having a high silver chloride content were developed at high speed. Generally, the greater the amount of titanium dioxide in the support, the higher the sharpness. However, the prints made from the samples using polyethylene as the resin were inferior in surface gloss. On the other hand, the prints made of the samples using polyethyleneterephthalate as the resin exhibited improved surface gloss, but they were colored at the cut edges. The larger the amount of titanium dioxide in the support, the more the prints would be colored at their cut edges. The prints made of the samples according to the present invention exhibited sufficient surface gloss, and were were not colored at cut edges, owing to the above-mentioned specific range of the ratio between all binder used and all silver halide used. Samples 137 to 154, in which this ratio was far outside this range, were inferior.

Thus, the present invention can provide a light-sensitive material which can be developed at high speed, which excels in sharpness, and which can be processed to form prints which have good surface gloss and are not colored at their cut edges.

Example 2

The support of sample 131 prepared in Example 1 was replaced by the supports G, H, I and J shown in Table 2, thereby preparing multi-colored printing papers. These printing papers were tested in the same way as in Example 1. The prints made of these printing papers had high sharpness: and good gloss, and were not colored at their edges.

Example 3

The layers 2, 3, and 4 of the samples prepared in Example 1 were changed in composition as shown in the following Table 10, thereby preparing multi-layered light-sensitive materials. These materials were tested in the same way as in Example 1 for their properties. Like the materials of Example 1, in the constitution of the present invention, they could be developed at high speed, and the prints made from them excelled in sharpness and surface gloss and were not colored at their cut edges.

TABLE 10

| | |
|---|---|
| Layer 2: Color-amalgamation inhibiting layer | |
| Gelatin | 0.99 |
| Color-amalgamation inhibitor (Cpd-A) | 0.04 |
| Color-amalgamation inhibitor (Cpd-B) | 0.04 |
| Solvent (Solve-2) | 0.16 |
| Solvent (Solve-3) | 0.08 |
| Solvent (Solve-10) | 0.03 |
| Layer 3: Green-sensitive emulsion layer | |
| Silver chlorobromide emulsion G2 | 0.12 |
| Gelatin | 1.24 |
| Magenta coupler (M-A) | 0.26 |
| Dye image stabilizer (Cpd-8) | 0.03 |
| Dye image stabilizer (Cpd-5) | 0.04 |
| Dye image stabilizer (Cpd-6) | 0.02 |
| Dye image stabilizer (Cpd-2) | 0.02 |
| Solvent (Solv-8) | 0.30 |
| Solvent (Solv-9) | 0.15 |
| Layer 4: Color-amalgamation inhibiting layer | |
| Gelatin | 0.70 |
| Color-amalgamation inhibitor (Cpd-A) | 0.03 |
| Color-amalgamation inhibitor (Cpd-B) | 0.03 |
| Solvent (Solv-2) | 0.11 |
| Solvent (Solv-3) | 0.06 |
| Solvent (Solv-10) | 0.02 |

The compounds used in the layers specified in Table 10 are as follows:

(Cpd-A)

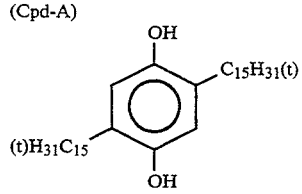

(Cpd-B)

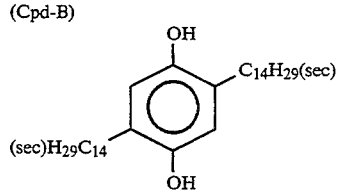

(M-A)

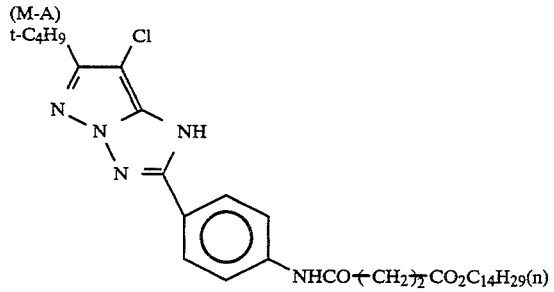

-continued

Solvent (Solv-8)

$O{=}P{-}(O{-}C_6H_{13}(n))_3$

Solvent (Solv-9)

$COOC_4H_9$
|
$(CH_2)_8$
|
$COOC_4H_9$

Solvent (Solv-10)

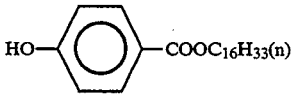

Example 4

Samples 113,131, and 149, prepared in Example 1, were subjected to scanning exposure, and the construction of images formed thereby were examined in detail. The test pattern used in the scanning exposure was one consisting of a white background and 1 mm-thick vertical and horizontal lines on the white background, arranged at intervals of 5 mm. The samples were A4-sized, and were exposed to light and color-developed in the same way as in Example 1, using the same solutions in Example 1. The details of the scanning exposure were as follows:

(Exposure)

The apparatus used in this scanning exposure was one which emits three laser beams. The first beams had a wavelength of 473 nm and was obtained by changing, by an SHG crystal of $KNbO_3$, the wavelength of a beam emitted by an YAG solid laser (oscillation wavelength: 946 nm) which had a GaAlAs semiconductor laser (oscillation wavelength: 808.5 nm) used as excitation light source. The second beam had a wavelength of 532 nm and was obtained by changing, by an SHG crystal of KTP, the wavelength of a beam emitted by an $YVO_4$ solid laser (oscillation wavelength: 1064 nm) which had a GaAlAs semiconductor laser (oscillation wavelength: 808.7 nm) used as excitation light source. The third beam was emitted by an AlGaInP laser (Model No. TOLD9211 manufactured by Toshiba, having an oscillation wavelength of about 670 nm). The apparatus used in the present invention is one that the laser beams could be reflected by a spinning polygonal mirror and applied onto each sheet of color printing paper which was moving in a direction perpendicular to the scanning direction. By using the apparatus, the amount of light to apply to the paper was varied to determine D-logE, where D is the density of the light-sensitive material and the E is the amount of light. The three laser beams were changed in their amount by an external modulator before they are applied to each sample, thus adjusting the exposure amount. This scanning exposure was performed at 400 dpi, so that each dot was exposed for an average of about $5\times10^{-8}$ sec. The semiconductor lasers were maintained at a specific temperature by means of Peltier elements to suppress the exposure-amount fluctuation due to the changes in temperature.

As a result, the sample 113 was colored at its cut edges after it had been subjected to scanning exposure and color development and, hence, could hardly be used practically. The sample 149 having a high binder-to-silver ratio was found to have a displacement among the yellow, magenta and cyan images which increased away from the center of scanning.

The sample according to the present invention, subjected to scanning exposure and then to color processing, was found to have little chromatic aberration at the neighborhoods of the region subjected to the scanning exposure.

Example 5

(Preparation of Emulsions)

First, 32 g of lime-treated gelatin was added to 800 cc of distilled water and dissolved therein at 40° C. Then, 5.75 g of sodium chloride was added to the resultant solution, which was heated to 55° C. To this solution, 1.0 cc of N,N'-dimethylimidazolin-2-thion (1% aqueous solution) was added. Thereafter, a solution prepared by dissolving 100 g of silver nitrate in 400 cc of distilled water, and a solution prepared by dissolving 34.4 g of sodium chloride were added to the above-mentioned solution and mixed therewith over 35 minutes, while maintaining the the solution at 55° C. Next, a solution prepared by dissolving 59.2 g of silver nitrate in 200 cc of distilled water, and a solution prepared by 17.1 g of sodium chloride in 200 cc of distilled water were added to the solution over 18 minutes while maintaining the solution at 55° C. After the resultant solution was cooled to 40° C, the green-sensitive sensitizing dye G was added in an amount of $4\times10^{-4}$ mol per mol of silver halide, and the sensitizing dye D was added in an amount of $7\times10^{-5}$ per mol of silver halide. Then, a solution prepared by dissolving 0.8 g of silver nitrate in 100 cc of distilled water, and a solution prepared by dissolving 0.56 g of potassium bromide in 100 cc of distilled water were added to the solution over 10 minutes while maintaining the solution at 40° C. After the resultant solution was desalted and water-washed, 90 g of lime-treated gelatin was added to the solution. Further, sodium chloride and sodium hydroxide were added, thereby adjusting pAg and pH to 7.3 and 6.2, respectively. The solution was heated to 50° C and optimally sulfur-sensitized using the sulfur sensitizer which will be specified below. As a result, a silver chlorobromide emulsion A (silver bromide content: 0.5 mol %) was prepared.

Another silver chlorobromide emulsion B was prepared in the same way as the emulsion A, except that it was optimally selenium-sensitized using the selenium sensitizers which will be specified below, instead of sulfur sensitization in the emulsion A.

Still another silver chlorobromide emulsion C was prepared in the same way as the emulsion A, except that it was optimally tellurium-sensitized using the tellurium sensitizers which will be specified below, instead of sulfur sensitization in the emulsion A.

A further silver chlorobromide emulsion D was prepared in the same way as the emulsion A, except that it was optimally gold-sensitized using chloroauric, instead of the sulfur sensitization in the emulsion A.

Furthermore, a silver chlorobromide emulsion E was prepared in the same way as the emulsion A, except that it was not optimally sulfur-sensitized but also optimally gold-sensitized with chloroauric acid.

As the green-sensitive sensitizing dyes and the chemical sensitizers were used the compounds as illustrated below.

TABLE 11

| Green-sensitive sensitizing dye |
|---|
| Sensitizing dye G |
| 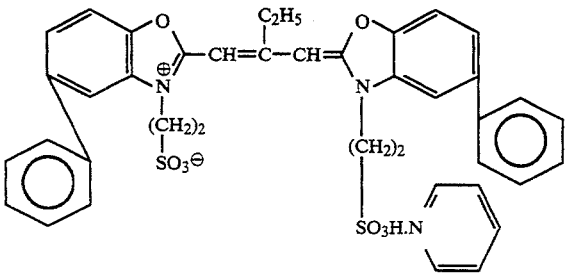 |
| Sensitizing dye D |
| 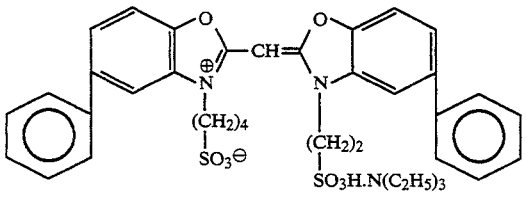 |
| 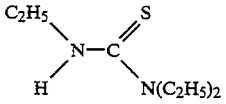 |
| 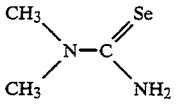 |
| 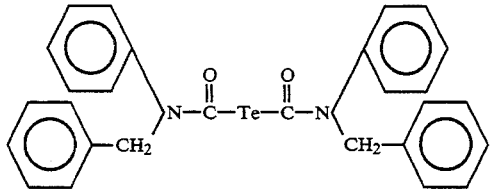 |

Electron microscopic photographs of the emulsions A to E thus prepared were examined for their grain shapes, grain sizes, and grain-size distributions. The grain size was the average of the sizes of the individual grains, each grain size being the diameter of a circle equivalent to the projected area of the individual grain. The grain-size distribution was the standard deviation of grain size, divided by the average grain size. The emulsions A to E were of the type which contained cubic grains having a size of 0.42 μm and a grain-size distribution of 0.10.

(Preparation of the raw Paper)

A wood pulp mixture (LBKP/NBSP=2/1) was beat into pieces, thereby obtaining pulp slurry of Canadian freeness of 250 cc. The pulp slurry was diluted with water, while stirring the diluted slurry, anionic polyacrylamide (Polystron 195 having a molecular weight of about 1,100,000, and manufactured by Arakawa Kagaku Co., Ltd.), aluminum sulfate, and polyamidopoly amine epichlohydrin (Caimen 557 manufactured by Dick Hercules, Inc.) were added to the slurry in amounts of 1.0%, 1.0%, and 0.15% by weight (based on the pulp), respectively. Further, epoxlylated behenic acid amide and alkylketenedimer (a compound having alkyl group $C_{20}H_{41}$) were added, each in an amount of 0.4% by weight (based on the pulp), to the slurry. Sodium hydroxide was added, thereby adjusting the pH value to 7. Then, cationic polyacrylamide and de foaming agent were added in amounts of 0.5% and 0.1% by weight (based on the pulp), respectively. Using the slurry, thus prepared, a raw paper was made which had a weighting capacity of 180 g/m$^2$.

Next, the raw paper was dried in an oven, adjusting its water content to about 2%. A surface sizing agent (an aqueous solution) having the composition specified below was size-pressed onto the raw paper, whereby the solution was coated in an amount of 20 g/m$^2$ on that surface of the raw paper on which photographic emulsions were to be coated.

| Composition of the surface sizing agent | |
|---|---|
| Polyvinyl alcohol: | 4.0% |
| Calcium chloride: | 4.0% |
| Fluorescent whitening agent: | 0.5% |
| Defoaming agent: | 0.005% |

Then, the raw paper coated with the sizing agent was surface-treated by means of a machine calender, to have its thickness adjusted to 180 μm.

Wood pulp consisting of 70 parts of LBKP and 30 parts of LBSP was beat into pieces by a discrefiner, and then dissolved in 290 cc of CSF, thereby forming a slurry. Alkylketenedimer (Acopel I2 manufactured by Dick Hercules, Inc.), anionic polyacrylamide (Polystron 194-7 manufactured by Arakawa Kagaku Co., Ltd.), cationic polyacrylamide (Polystron 705 manufactured by Arakawa Kagaku Co., Ltd.), and polyamidopolyamine epichlohydrin (Caimen 557 manufactured by Dick Hercules, Inc.) were added as neutral sizing agents to the slurry in amounts of 1.0 part, 1.0 part, 0.5 parts, and 0.3 parts by absolute dry weight based on the pulp, respectively. Then, the slurry was processed by a long-net paper machine into a raw paper A having a weighting capacity of 170 g/m$^2$ and a thickness of 165 μm.

The pH value of the raw paper A was measured by using hot-water extraction method of JIS-P-8133; it was found to be 6.4.

Furthermore, other raw papers B, C, D, E, and F were prepared in the following methods.

A slurry was prepared which was identical to the slurry used in preparing the raw paper A. Epoxylated fatty acid amide (NS-715 manufactured by Kindai Kagaku Kogyo Co., Ltd.), anionic polyacrylamide (Polystron 194-7 manufactured by Arakawa Kagaku Co., Ltd.), aluminum sulfate, NaOH, and cationic starch were added to the slurry in amounts of 0.6 parts, 1.2 parts, 1.0, 0.9 parts, and 1.0 part by absolute dry weight based on the pulp, respectively. Then, the slurry was processed in the same way as the raw paper A, into a raw paper B having a weigting capacity of 170 g/m$^2$ and a thickness of 165 μm. The raw paper B had a pH value of 7.3.

A slurry was prepared which was identical to the slurry used in preparing the raw paper A. Sodium stearate, anionic polyacrylamide (Polystron 194-7 manufactured by Arakawa Kagaku Co., Ltd.), and aluminum sulfate were added to the slurry in amounts of 1.0 part, 1.0 part, and 1.5 part by absolute dry weight based on the pulp, respectively. Then, the slurry was processed in the same way as the raw paper A, into a raw paper C having a weighting capacity of 170 g/m$^2$ and a thickness of 166 μm. The raw paper C was found to have a pH value of 3.8 when tested by the hot-water extraction method. The raw paper D was prepared in the same way as the substrate C, except that 0.5 parts of sodium aluminate was added to the slurry after aluminum sulfate had been added thereto. The raw paper D was found to have a pH value of 4.7 when tested by the hot-water extraction method.

The raw papers E and F were prepared in the same way as the raw paper B, except that the amount in which NaOH was added was changed. These raw papers E and F had a pH value of 7.8 and a pH value of 8.5, respectively.

(Preparation of the Support)

Polyesters (having a maximum viscosity of 6.5 and a molecular weight of about 40,000) shown in the following Table 12, each obtained by polycondensation of dicarboxylic acid and ethylene glycol, and polyethlenes were mixed individually with titanium oxide (KA-10 manufactured by Titan Kogyo Co., Ltd.) were also individually, thereby forming mixtures. Each of the mixtures thus prepared was melted at 300° C., and mixed and extruded through a T die by a two-roll mixer-extruder onto the surface of the raw paper, thereby laminating a layer having a thickness of 30 μm on one surface of the raw paper. A resin composition containing calcium carbonate was melt and onto the other surface of the raw paper, thus laminating a layer having a thickness of 30 μm. The raw paper was laminated on both surfaces. That surface of the laminated reflective support on which to coat emulsions was processed with corona discharge treatment, and was coated, in an amount of 5 cc/m², with a solution having the following composition. The reflective support was dried at 80° C. for 2 minutes. As a result, several types of reflective supports were prepared.

| Composition of the undercoating | |
|---|---|
| Compound (ExU1) indicated below: | 0.2 g |
| Compound (ExU2) indicated below: | 0.001 g |
| $H_2O$ | 35 cc |
| Methanol | 65 cc |
| Gelatin | 2 g |
| pH | 9.5 |

TABLE 12

| Coating layer | Resin (dicarboxylic acid composition of polyester | $TiO_2$ (wt %) |
|---|---|---|
| A | Polyethylene | 15 |
| B | Polyester (terephthalic acid) | 25 |
| C | Polyester (terephthalic acid/ isophthalic acid = 1/1) | 25 |
| D | Polyester (terphthalic acid/ naphthalenedicarboxylic acid = 1/1) | 25 |

Compound (ExU1)

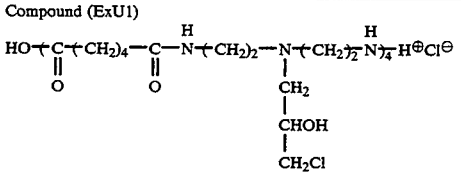

Compound (ExU2)
$C_{12}H_{25}O(CH_2CH_2O)_{10}H$ (Preparation of Samples)

Various photographic layers were coated on the supports thus prepared, thereby preparing color photographic printing paper having the following multi-layered structure. The coating solutions were prepared as follows: Preparation of each layer coating solution To prepare the first layer coating solution, 153.0 g of a yellow coupler (ExY), 15.0 g of a dye image stabilizer (Cpd-1), 7.5 g of a dye image stabilizer (Cpd-2), and 1.6.0 g of a dye image stabilizer (Cpd-3) were dissolved in 25 g of a solvent (Solv-1), 25 g of another solvent (Solv-2), and 180 cc of ethyl acetate, thereby forming a solution. This solution was emulsified and dispersed by an ultrasonic homogenizer into 1000 g of a 10% gelatin aqueous solution containing 60 cc of 10% sodium dodecylbenzensulfonate and 10 g of citric acid, thus forming an emulsified dispersion. The emulsified dispersion and a silver chlorobromide emulsion were mixed and dissolved, thereby preparing the first layer coating solution.

The second to seventh layer coating solutions were prepared in the same way as the first layer coating solution. In each of the seven coating solutions, 1-oxy-3,5-dichloro-s-triazine sodium salt was used as the gelatin-hardening agent.

Also, Cpd-14 and Cpd-15 were added to each layer, in total amounts of 25.0 mg/m² and 50.0 mg/m², respectively.

The spectral sensitizing dyes used in each layer were those specified in the following Tables 13 and 14:

TABLE 13

Blue-sensitive emulsion layer

Sensitizing dye A

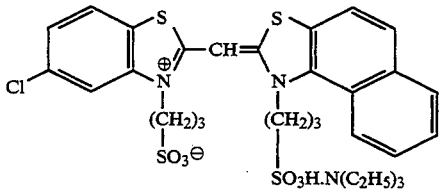

and

Sensitizing dye B

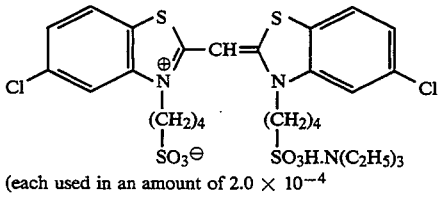

(each used in an amount of $2.0 \times 10^{-4}$ mol per mol of silver halide)

TABLE 14

Red-sensitive emulsion layer

Sensitizing dye E

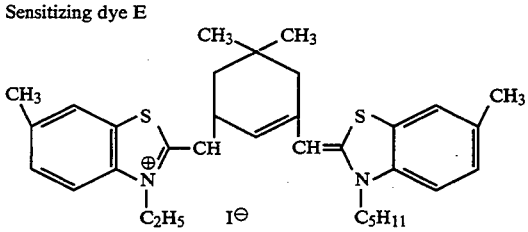

(Dye E was added to the emulsion containg large size grains in an amount of $0.9 \times 10^{-4}$ mol per mol of silver halide, and to the emulsion containing small size grains in an amount of $1.1 \times 10^{-4}$ mol per mol of silver halide.) Further, the following compound was added in an amount $2.6 \times 10^{-3}$ mol per mol of silver halide.

TABLE 14-continued

Red-sensitive emulsion layer

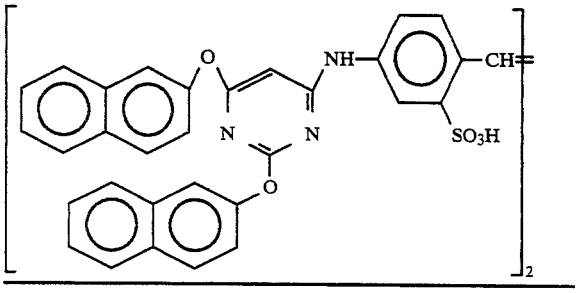

Moreover, 1-(5-methylureidophenyl)-5-mercaptotetrazole was added to the green-sensitive emulsion layer in an amount of $7.7\times10^{-4}$ mol per mol of silver halide.

Further, 4-hydroxy-6-methyl-1,3,3a,7-tetraazinedine was added to the blue-sensitive emulsion layer in an amount of $1.0\times10^{-4}$ mol per mol of silver halide, and to the green-sensitive emulsion layer in an amount of $2.0\times10^{-4}$ mol per mol of silver halide.

In order to prevent irradiation, the dyes identified below were added to each emulsion layer (in the coated amounts specified in the parentheses.)

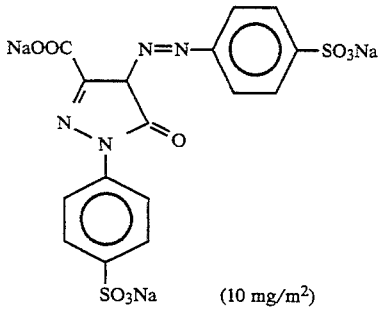

(10 mg/m²)

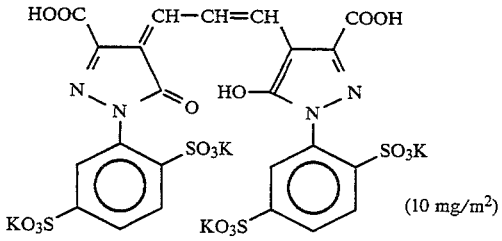

(10 mg/m²)

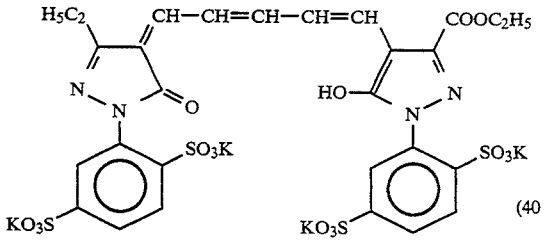

(40 mg/m²)

and

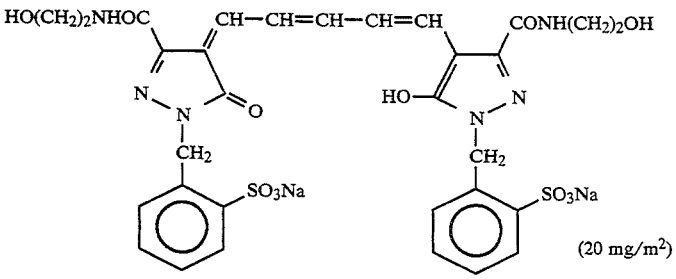

(20 mg/m²)

The composition of each layer will be described. The numerals specified along with each component indicates the coating amount (g/m²) of the component. The coating amount of a silver halide is represented in terms of the amount of silver coated. The compounds added in each layer are represented in Table 15 and by the structure described below.

TABLE 15

| Support<br>Polyethylene-laminated paper<br>(including the first layer of polyethylene containing a while pigment ($TiO_2$) and a blue dye (ultramarine)) | |
|---|---|
| Layer 1: Blue-sensitive emulsion layer | |
| Silver chlorobromide emulsion (containing silver chlorobromide cubic grains having an average size of 0.7 μm, a variation coefficient of 0.1 in terms of size distribution, AgBr content of 0.3 mol %) | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Layer 2: Color-amalgamation inhibiting layer | |
| Gelatin | 1.00 |
| Color-amalgamation inhibitor (Cpd-4) | 0.06 |
| Solvent (Solv-7) | 0.03 |
| Solvent (Solv-2) | 0.25 |
| Solvent (Solv-3) | 0.25 |
| Layer 3: Green-sensitive emulsion layer | |
| Silver chlorobromide emulsion | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |

TABLE 15-continued

| Support<br>Polyethylene-laminated paper<br>(including the first layer of polyethylene containing a while pigment ($TiO_2$) and a blue dye (ultramarine)) | |
|---|---|
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Layer 4: Color-amalgamation inhibiting layer | |
| Gelatin | 0.70 |
| Color-amalgamation inhibitor (Cpd-4) | 0.04 |
| Solvent (Solv-7) | 0.02 |
| Solvent (Solv-2) | 0.18 |
| Solvent (Solv-3) | 0.18 |
| Layer 5: Red-sensitive emulsion layer | |
| Silver chlorobromide emulsion (a mixture of an emulsion containing cubic grains having an average size of 0.50 μm and an emulsion containing grains having a size of 0.41 μm, mixed together in an Ag mol ratio of 1:4; these emulsions had variation coefficients of 0.09 and 0.11, respectively, in terms of the grain-size distribution. Either emulsion contained silver halide grains, each consisting of 0.8 mol % of AgBr locally existing in the surface region and the remainder being silver chloride grains.) | 0.20 |
| Gelatin | 0.85 |
| Cyan coupler (ExC) | 0.33 |
| Ultraviolet absorbent (UV-2) | 0.18 |
| Dye image stabilizer (Cpd-9) | 0.02 |
| Dye image stabilizer (Cpd-10) | 0.02 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.33 |
| Layer 6: Ultraviolet-absorbing layer | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| Layer 7: Protective layer | |
| Gelatin | 1.13 |
| Acrylic modified copolymer of polyvinyl alcohols (modification degree: 17%) | 0.05 |
| Liquid paraffin | 0.02 |
| Dye image stabilizer (Cpd-13) | 0.01 |

Yellow coupler (ExY)

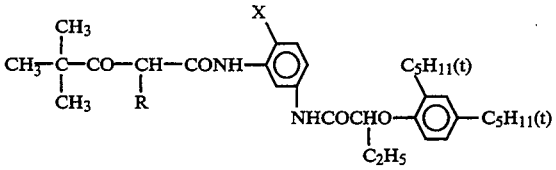

This is a 1:1 mixture (molar ratio) of the following compounds (1) and (2):

(1)

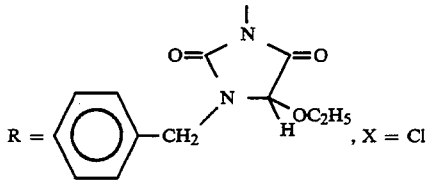

and (2)

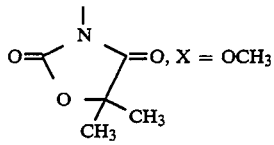

Magenta coupler (ExM)

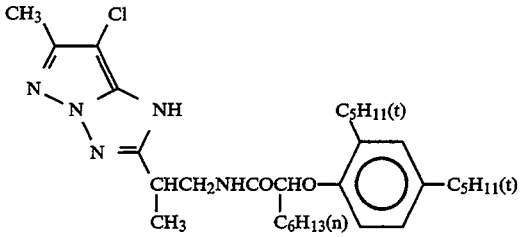

Cyan coupler (ExC)

This is a 3:7 mixture (molar ratio) of the following two compounds:

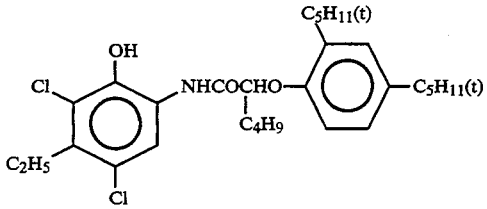

and

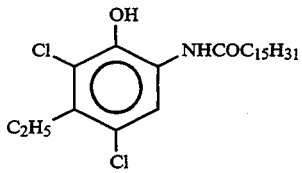

Dye image stabilizer (Cpd-1)

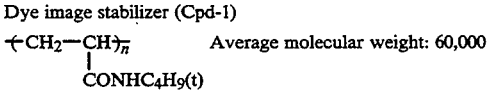

Average molecular weight: 60,000

Dye image stabilizer (Cpd-2)

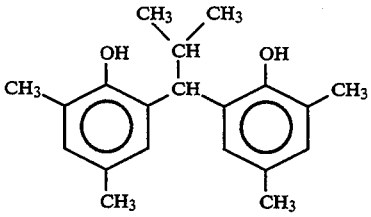

Dye image stabilizer (Cpd-3)

-continued

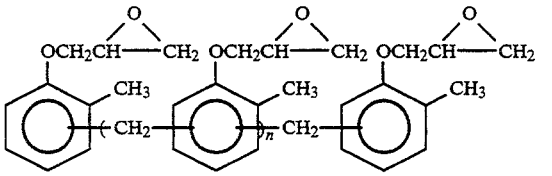

n =7 to 8 (ave. value)

Color-amalgamation inhibitor (Cpd-4)

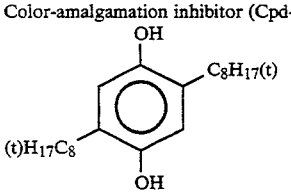

Dye image stabilizer (Cpd-5)

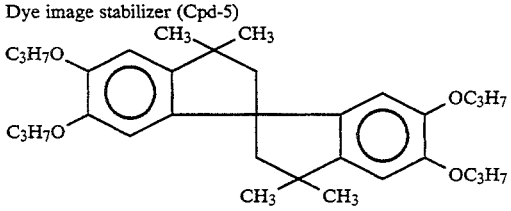

Dye image stabilizer (Cpd-6)

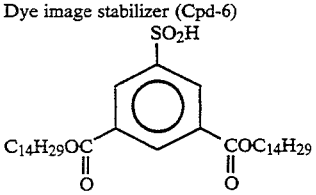

Dye image stabilizer (Cpd-7)

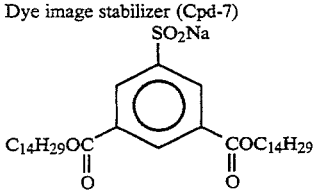

Dye image stabilizer (Cpd-8)

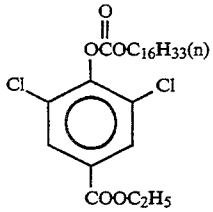

Dye image stabilizer (Cpd-9)

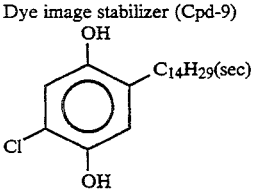

Dye image stabilizer (Cpd-10)

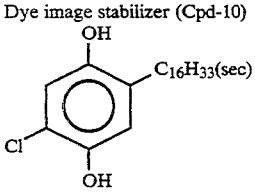

-continued

Dye image stabilizer (Cpd-11)

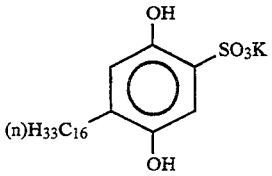

Dye image stabilizer (Cpd-12)

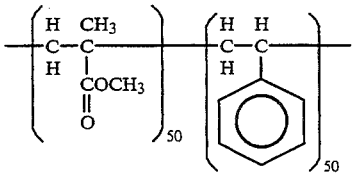

Average molecular weight: about 60,000

Dye image stabilizer (Cpd-13)

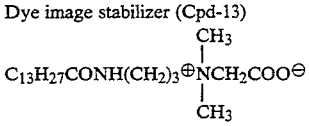

Antiseptic agent (Cpd-14)

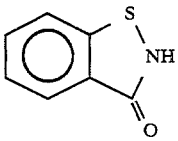

Antiseptic agent (Cpd-15)

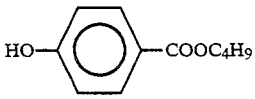

Ultraviolet absorbent (UV-1)

A mixture of the following compounds (1), (2), (3) and (4) mixed together weight ratio of 1:5:10:5

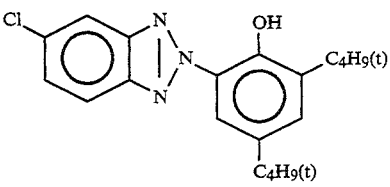

(1)

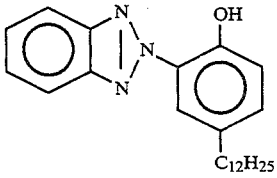

(2)

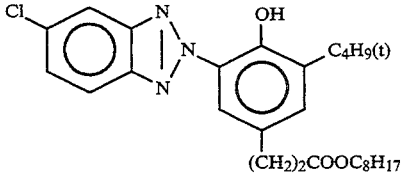

(3)

-continued (4)

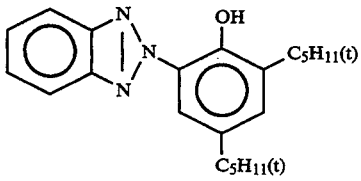

Ultraviolet absorbent (UV-2)

A mixture of the following compounds (1), (2) and (3) mixted together in weight ratio of 1:2:2

(1)

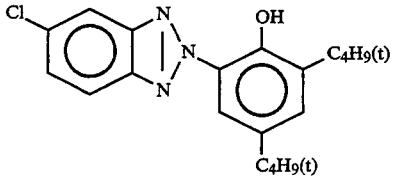

(2)

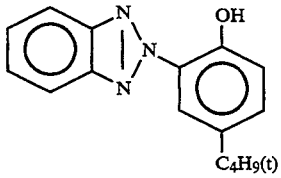

(3)

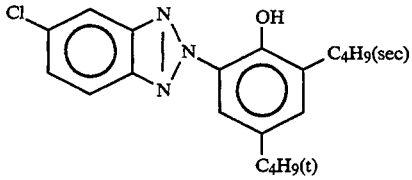

Solvent (Solv-1)

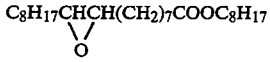

Solvent (Solv-2)

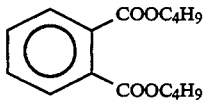

Solvent (Solv-3)

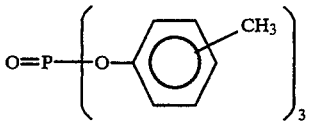

Solvent (Solv-4)

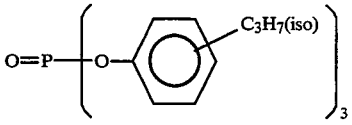

Solvent (Solv-5)

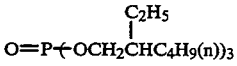

Solvent (Solv-6)

-continued

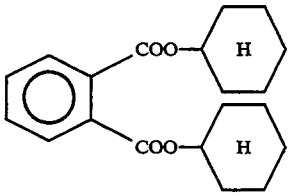

Solvent (Solv-7)

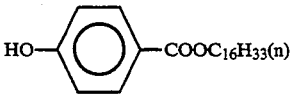

To determine the pressure characteristics which the samples thus prepared might have after stored for a long period of time, the samples were stored in an atmosphere of 50 atm. for one week. Then, each sample was bent by 40° C., spending 1 second, around a stainless steel round bar having a diameter of 2 mm. Thereafter, the samples were exposed for 1/10 second to light applied through an optical wedge and a green filter. The samples were then subjected to color processing in the method to be described below, using the process solutions which will be specified later. The densities of the bent portion and unbent portion of each sample were measured by a micro-densitometer at the exposure amount which imparts a density of 2.0 to the sample, thereby finding the decrease ΔD. A ΔD of a negative value means that the pressure has induced desensitization. The greater the absolute value of ΔD, the higher the degree of desensitization.

The surface gloss of the support of each sample was measured by Suga.handy glossmeter before the photographic composition layers were formed on the support. The greater the value measured, the more excellent in the surface gloss.

| Processing Steps | | |
|---|---|---|
| Step | Temperature | Time |
| Color development | 35° C. | 45 sec. |
| Bleach-fixing | 30–35° C. | 45 sec. |
| Rinsing 1 | 30–35° C. | 20 sec. |
| Rinsing 2 | 30–35° C. | 20 sec. |
| Rinsing 3 | 30–35° C. | 20 sec. |
| Drying | 70–80° C. | 60 sec. |

The compositions of the solutions are as follows:

| | |
|---|---|
| Color Developing Solution: | |
| Water | 800 ml |
| Ethylenediamine-N,N,N'N-tetrametyylen sulfonic acid | 1.5 g |
| Potassium bromide | 0.015 g |
| Triethanolamine | 8.0 g |
| Sodium chloride | 1.4 g |
| Potassium carbide | 25 g |
| N-ethyl-N-(β-methanesulfon-amido-ethyl)-3-methyl-4-amino-aniline sulfate | 5.0 g |
| N,N-bis(carboxymethyl)hydrazine | 4.0 g |
| N,N-di(sulfoethyl)hydroxylamine.1Na | 4.0 g |
| Fluorescent whitening agent (WHITEX 4B, Sumitomo Kagaku) | 1.0 g |
| Water to make | 1000 ml |
| pH (25° C.) | 10.05 |
| Bleach-fixing solution | |
| Water | 400 ml |

-continued

| | |
|---|---|
| Ammonium thiosulfate (70%) | 100 ml |
| Sodium sulfite | 17 g |
| Ammonium Fe (III) ethylenediamine tetraacetate | 55 g |
| Disodium ethylenediamine tetraacetate | 5 g |
| Ammonium bromide | 40 g |
| Water to make | 1000 ml |
| pH (25° C.) | 6.0 |
| Rinsing solution | |
| Ion-exchange water (calcium and magnesium, each in an amount of 3 ppm or less) | |

The results were as is shown in the following Table 16.

TABLE 16

| Raw paper (pH) | Coating layer | Emulsion in green-sensitive layer (Type of chemical sensitizer) | Gloss (%) | Density decrease due to pressure under pressure with time (ΔD) | Remarks |
|---|---|---|---|---|---|
| C (3.8) | A | A (S) | 78 | −0.6 | Comparative example |
| " | " | B (Se) | " | −0.4 | " |
| " | " | C (Te) | " | −0.4 | " |
| " | " | D (Au) | " | −0.5 | " |
| " | " | E (S/Au) | " | −0.6 | " |
| " | B | A (S) | 102 | −1.8 | " |
| " | " | B (Se) | " | −1.7 | " |
| " | " | C (Te) | " | −1.7 | " |
| " | " | D (Au) | " | −1.9 | " |
| " | " | E (S/Au) | " | −1.8 | " |
| A (6.4) | A | A (S) | 78 | −0.5 | " |
| " | " | B (Se) | " | −0.5 | " |
| " | " | C (Te) | " | −0.6 | " |
| " | " | D (Au) | " | −0.4 | " |
| " | " | E (S/Au) | " | −0.6 | " |
| " | B | A (S) | 102 | −1.7 | " |
| " | " | B (Se) | " | −0.3 | Present invention |
| " | " | C (Te) | " | −0.2 | " |
| " | " | D (Au) | " | −0.2 | " |
| " | " | E (S/Au) | " | −0.3 | " |
| D (4.7) | A | A· (S) | 78 | −0.5 | Comparative example |
| " | " | C (Te) | " | −0.5 | " |
| " | B | A (S) | 102 | −1.8 | " |
| " | " | C (Te) | " | −1.5 | " |
| B (7.3) | A | A (S) | 78 | −0.6 | " |
| " | " | D (Au) | " | −0.7 | " |
| " | B | A (S) | 102 | −1.9 | " |
| " | " | D (Au) | " | −0.2 | Present invention |
| " | C | A (S) | 96 | −1.3 | Comparative example |
| " | " | E (S/Au) | " | −0.3 | Present invention |
| " | D | A (S) | 98 | −1.5 | Comparative example |
| " | " | E (S/Au) | " | −0.3 | Present invention |
| E (7.8) | B | A (S) | 102 | −1.8 | Comparative example |
| " | " | D (Au) | " | −0.3 | Present invention |
| F (8.5) | " | A (S) | " | −1.7 | Comparative example |
| " | " | D (Au) | " | −0.3 | Present invention |

As is evident from Table 16, the resin of the supports of polyester resin excelled in gloss, but were poor in a resistance to pressure after the samples had been stored for a long period of time. Those of the samples which had been prepared using the raw papers having a neutral pH value and using selenium-, tellurium- or gold-sensitized emulsions exhibited not only much improved a resistance to pressure but also good surface gloss.

Example 6

Samples were prepared which were identical to those of Example 5, except that the compositions of the layers 2, 3, and 4 were changed as will be shown in the following Table 17. These samples were tested in the same way as in Example 5, to evaluate their properties. The results were as is shown also in Table 17. As just the same as in Example 5, those of the samples which had been prepared using the raw papers having a neutral pH value and using selenium-, tellurium- or gold-sensitized emulsions exhibited not only much improved a resistance to pressure but also good surface gloss.

TABLE 17

| | |
|---|---|
| **Layer 2: Color-amalgamation inhibiting layer** | |
| Gelatin | 0.99 |
| Color-amalgamation inhibitor (Cpd-A) | 0.04 |
| Color-amalgamation inhibitor (Cpd-B) | 0.04 |
| Solvent (Solv-10) | 0.16 |
| Solvent (Solv-11) | 0.08 |
| Solvent (Solv-12) | 0.03 |
| **Layer 3: Green-sensitive emulsion layer** | |
| Silver chlorobromide emulsion | 0.12 |
| (Table 16) | |
| Magenta coupler (M-A) | 0.26 |
| Gelatin | 1.24 |
| Dye image stabilizer (Cpd-16) | 0.03 |
| Dye image stabilizer (Cpd-17) | 0.04 |
| Dye image stabilizer (Cpd-18) | 0.02 |
| Dye image stabilizer (Cpd-19) | 0.02 |
| Solvent (Solv-8) | 0.30 |
| Solvent (Solv-9) | 0.15 |
| **Layer 4: Color-amalgamation inhibiting layer** | |
| Gelatin | 0.70 |
| Color-amalgamation inhibitor (Cpd-A) | 0.03 |
| Color-amalgamation inhibitor (Cpd-B) | 0.03 |
| Solvent (Solv-10) | 0.11 |
| Solvent (Solv-11) | 0.06 |
| Solvent (Solv-12) | 0.02 |

Dye image stabilizer (Cpd-16)

TABLE 17-continued
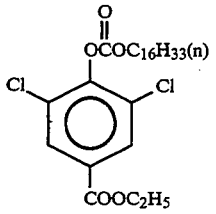
Dye image stabilizer (Cpd-17)
TABLE 17-continued
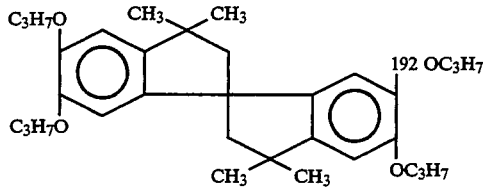
Dye image stabilizer (Cpd-18)
This is a mixture of the following compounds mixed together in molar ratio of 1:1
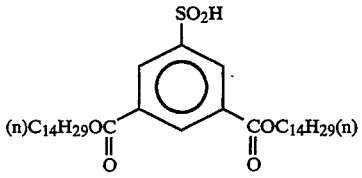
and
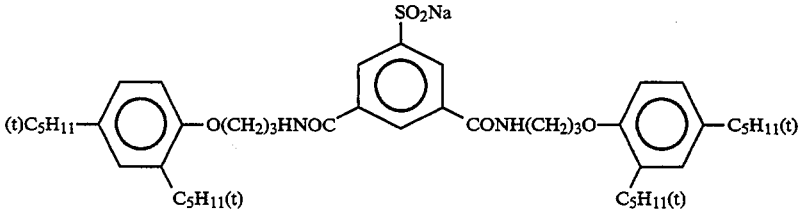
Dye image stabilizer (Cpd-19)
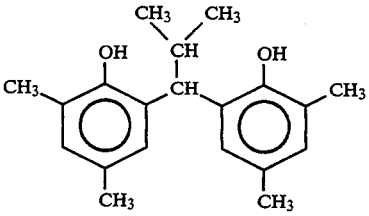
Cpd-A
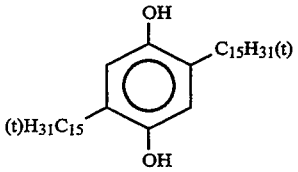
Cpd-B
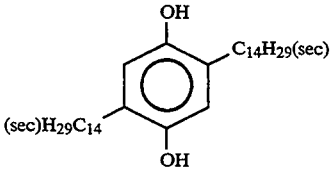
M-A
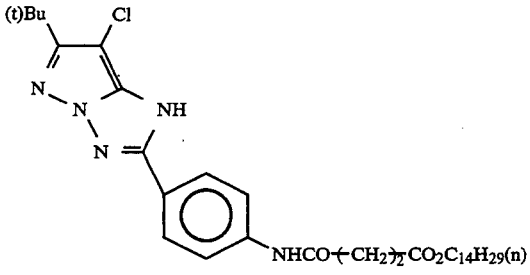
Solvent (Solv-8)
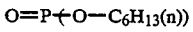
Solvent (Solv-9)
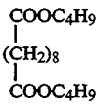
Solvent (Solv-10)
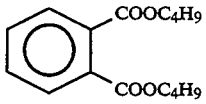
Solvent (Solv-11)
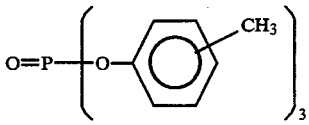
Solvent (Solv-12)

-continued

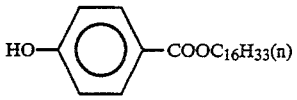

Example 7

Samples were prepared by a raw paper (pH: 7.3) and a coated layer B (polyester) used in Example 5 coated with the photographic composition layers used in Example 6 and by changing the compounds contained in the green-sensitive emulsion layer, except 1-(5-methylureidophenyl)-5-mercaptotetrazole, and the compounds contained in the green-sensitive emulsion, as is shown in Table 18. These samples were tested for their resistance to pressure, in the same method as in Example 5. The compounds were added in a total amount of $7.7\times10^{-4}$ mol per mol of silver halide. The results of the test were as is shown in Table 18.

TABLE 18

| Emulsion in green-sensitive layer (Type of chemical sensitization) | Compound added to the green-sensitive emulsion layer | Density decrease due to pressure after aged pressure (ΔD) | Remarks |
|---|---|---|---|
| A (S) | None | −1.9 | Comparative example |
| " | I-16 | −1.7 | " |
| " | II-12 | −1.8 | " |
| " | III-26 | −1.7 | " |
| " | IV-2-6 | −1.8 | " |
| C (Te) | None | −0.7 | Present invention |
| " | I-13 | −0.3 | " |
| " | II-15 | −0.2 | " |
| " | III-26 | −0.3 | " |
| " | IV-2-6 | −0.3 | " |
| E (S/Au) | None | −0.8 | " |
| " | I-16 | −0.3 | " |
| " | II-13 | −0.3 | " |
| " | III-26 | −0.3 | " |
| " | IV-1-5 | −0.5 | " |
| " | IV-2-5 | −0.4 | " |
| " | IV-3-33 | −0.5 | " |
| " | IV-4-6 | −0.5 | " |

As is evident from Table 18, those of the samples which contained the compound represented by the Formula (I), (II), (III) or (IV) excelled in a resistance to pressure in particular.

Example 8

Images were printed by means of a printer on the color printing paper of the present invention and the conventional, polyethylene resin coated printing paper, from the color negative film having a transparent magnetic recording layer, and the conventional color negative film having no transparent magnetic recording layer which is disclosed in JP-A-4-62543. The image printed on the conventional, polyethylene resin-coated printing paper from the negative film having a magnetic recording layer had its graininess deteriorated. In contrast, the image printed on the color printing paper of the present invention from the same negative film had its graininess scarcely deteriorated. Thus, the use of the printing paper of the present invention in combination with the color negative film having a magnetic recording layer provides a method of forming high-quality images having good resistance to pressure.

Example 9

Samples identical to those of Example 5 were tested for their resistance to pressure in the same way as in Example 5, except that the samples were exposed in the following specific method. The results of the test were same as in Example 5.

(Exposure)

The apparatus used in this exposure was one which emits three laser beams. The first beams had a wavelength of 473 nm and was obtained by changing, by an SHG crystal of $KNbO_3$, the wavelength of a beam emitted by an YAG solid laser (oscillation wave length: 946 nm) which had a GaAlAs semiconductor laser (oscillation wavelength: 808.5 nm) used as excitation light source. The second beam had a wavelength of 532 nm and was obtained by changing, by an SHG crystal of KTP, the wavelength of a beam emitted by an $YVO_4$ solid laser (oscillation wavelength: 1064 nm) which had a GaAlAs semiconductor laser (oscillation wavelength: 808.7 nm) used as excitation light source. The third beam was emitted by an AlGaInP laser (Model No. TOLD9211 manufactured by Toshiba, having an oscillation wavelength of about 670 nm). The apparatus used in the present invention is one that the laser beams could be reflected by a spinning polygonal mirror and applied onto each sheet of color printing paper which was moving in a direction perpendicular to the scanning direction. By using the apparatus, the amount of light to apply to the paper was varied to determine D-logE, where D is the density of the light-sensitive material and the E is the amount of light. The three laser beams were changed in their amount by an external modulator before they are applied to each sample, thus adjusting the exposure amount. This scanning exposure was performed at 400 dpi, so that each dot was exposed for an average of about $5\times10^{-8}$ sec. The semiconductor lasers were maintained at a specific temperature by means of Peltier elements to suppress the exposure-amount fluctuation due to the changes in temperature.

As has been described, the present invention can provide a color photographic light-sensitive material which can be processed at high speed, which can form prints excelling in sharpness while preserving high surface gloss, and having no coloring at the cut edges. The present invention can also provide a method of forming images, in which scanning exposure is performed on the light-sensitive material, thereby forming images having little chromatic aberration at at the edges.

Furthermore, the present invention can provide a silver halide color photographic light-sensitive material which excels in surface smoothness and surface gloss and which has its properties little deteriorated even after stored for a long time, and which can therefore form high-quality images, and also a method of forming such high-quality images.

What is claimed is:

1. A silver halide color photographic light-sensitive material comprising a reflective support having provided thereon at least one silver halide emulsion layer containing a yellow dye-forming coupler, at least one silver halide emulsion layer containing a magenta dye-forming coupler, and at least one silver halide emulsion layer containing a cyan dye-forming coupler, said support comprising a substrate and a composition layer laminated on at least the surface of said substrate on which said emulsion layers are coated, and made of a thermoplastic resin containing polyester as a main component and a white pigment mixed and dispersed in said resin, said polyester having been synthesized by the polycondensation of a dicarboxylic acid and a diol; said silver halide contained in the light-sensitive material being silver chlorobromide having silver chloride content of 95 mol % or more, or silver chloride; and the ratio of the coated amount ($g/m^2$) of all hydrophilic colloid coated on a support to the coated amount ($g/m^2$) of silver contained in all silver halide used in the light-sensitive material ranging from 5.0 to 30.

2. A silver halide color photographic light-sensitive material according to claim 1, wherein the substrate is paper.

3. A silver halide color photographic light-sensitive material comprising a reflective support having provided thereon at least one silver halide emulsion layer containing a yellow dye-forming coupler, at least one silver halide emulsion layer containing a magenta dye-forming coupler, and at least one silver halide emulsion layer containing a cyan dye-forming coupler, said support comprising a substrate and a composition layer laminated on at least the surface of said substrate on which said emulsion layers are coated, and made of a thermoplastic resin containing polyester as a main component and a white pigment mixed and dispersed in said resin, said polyester having been synthesized by the polycondensation of a dicarboxylic acid and a diol; said silver halide contained in the light-sensitive material being silver chlorobromide having silver chloride content of 95 mol % or more, or silver chloride and being gold sensitized; and the ratio of the coated amount ($g/m^2$) of all hydrophilic colloid coated on a support to the coated amount ($g/m^2$) of silver contained in all silver halide used in the light-sensitive material ranging from 5.0 to 30.

4. The silver halide color photographic light-sensitive material according to claim 3, wherein the polyester is polyethylene terephthalate as a main component.

5. The silver halide color photographic light-sensitive material according to claim 3, wherein said polyester is a polyester synthesized by the polycondensation of a dicarboxylic acid which is a mixture of terephthalic acid and isophthalic acid (molar ratio of 9:1 to 2:8) and a diol.

6. The silver halide color photographic light-sensitive material according to claim 3, wherein said polyester is a polyester synthesized by the polycondensation of a dicarboxy acid which is a mixture of terephthalic acid and naphthalenedicarboxylic acid (molar ratio of 9:1 to 2:8) and a diol.

7. The silver halide color photographic light-sensitive material according to claim 3, wherein said diol component is ethylene glycol.

8. The silver halide color photographic light-sensitive material according to claim 3, wherein the ratio by weight of said white pigment to said resin ranges from 5:95 to 70:30.

9. A silver halide color photographic light-sensitive material comprising a reflective support having provided thereon at least one light-sensitive emulsion layer, said reflective support comprising a raw paper having pH of 5 to 9 and a composition laminated on the surface of said raw paper on which said emulsion layers are coated, and made of a resin containing polyester as a main component and a white pigment mixed and dispersed in the resin; and said light-sensitive emulsion layer containing a silver halide emulsion which is selenium-sensitized, tellurium-sensitized or gold-sensitized, and which contains 95 mol % or more of silver chloride.

10. A silver halide color photographic light-sensitive material comprising a reflective support having provided thereon at least one light-sensitive emulsion layer, said reflective support comprising a raw paper having pH of 5 to 9 and a composition laminated on the surface of said raw paper on which said emulsion layers are coated, and made of a resin containing polyester as a main component and a white pigment mixed and dispersed in the resin; and said light-sensitive emulsion layer containing a silver halide emulsion which is selenium-sensitized, tellurium-sensitized or gold-sensitized, and which contains 95 mol % or more of silver chloride, and wherein said light-sensitive emulsion layer contains at least one of the compounds represented by the following Formulas (I), (II) and (III):

Formula (I)

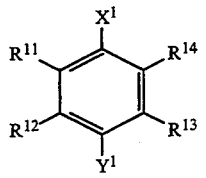

wherein $X^1$ and $Y^1$ independently represent a hydroxyl group, $—NR^{15}R^{16}$, or $—NHSO_2R^{17}$; $R^{11}$, $R^{12}$, $R^{13}$ and $R^{14}$ independently represent a hydrogen atom or any given substituent group; $R^{11}$ and $R^{12}$, and $R^{13}$ and $R^{14}$ may be bonded to each other to form a carbon ring, respectively; $R^{15}$ and $R^{16}$ independently represent a hydrogen atom, an alkyl group, an aryl group, or a heterocyclic group; $R^{15}$ and $R^{16}$ may be bonded to each other to form a nitrogen-containing heterocyclic ring; and $R^{17}$ represents an alkyl group, an aryl group, an amino group, or a heterocyclic group:

Formula (II)

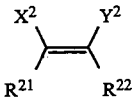

wherein $X^2$ and $Y^2$ independently represent a hydroxyl group, $—NR^{23}R^{24}$, or $—NHSO_2R^{25}$; $R^{21}$ and $R^{22}$ independently represent a hydrogen atom or any given substituent group; $R^{21}$ and $R^{22}$ may be bonded to each other to form a carbon ring or a heterocyclic ring; $R^{23}$ and $R^{24}$ independently represent a hydrogen atom, an alkyl group, an aryl group, or a heterocyclic group; $R^{23}$ and $R^{24}$ may be bonded to each other to form a nitrogen-containing heterocyclic ring; and $R^{25}$ represents an alkyl group, an aryl group, an amino group, or a heterocyclic group:

$$R^{31}\text{-}(Y^3)_n\text{-}NH\text{-}X^3$$ Formula (III)

wherein $X^3$ represents a hydroxyl group or $—NR^{32}R^{33}$; $Y^3$ represents a —CO— or $—SO_2—$; $R^{31}$ represents a hydrogen atom or any given substituent group; n is 0 or 1; $R^{32}$ and $R^{33}$ independently represent a hydrogen atom, an alkyl group, an aryl group, or a heterocyclic group; $R^{31}$ and $R^{32}$, and $R^{32}$ and $R^{33}$ may be bonded to each other to form a nitrogen-containing heterocyclic ring, respectively.

11. The silver halide color photographic light-sensitive material according to claim 10, wherein the polyester is polyethylene terephthalate as a main component.

12. The silver halide color photographic light-sensitive material according to claim 10, wherein said polyester is a polyester synthesized by the polycondensation of a dicarboxylic acid and a diol; and said dicarboxylic acid is a mixture of terephthalic acid and isophthalic acid.

13. The silver halide color photographic light-sensitive material according to claim 10, wherein said polyester is a polyester synthesized by the polycondensation of a dicarboxylic acid and a diol; and said dicarboxylic acid is a mixture of terephthalic acid and naphthalenedicarboxylic acid.

14. The silver halide color photographic light-sensitive material according to claim 12, wherein said diol is ethylene glycol.

15. The silver halide color photographic light-sensitive material according to claim 10, wherein said white pigment is titanium dioxide, and the ratio by weight of said white pigment to said resin ranges from 5:95 to 50:50.

16. The silver halide color photographic light-sensitive material according to claim 10, wherein said light-sensitive emulsion layer contains at least one mercapto heterocyclic compound.

* * * * *